US007168485B2

(12) United States Patent
Johnson et al.

(10) Patent No.: US 7,168,485 B2
(45) Date of Patent: Jan. 30, 2007

(54) EXPANDABLE SYSTEMS THAT FACILITATE DESIRED FLUID FLOW

(75) Inventors: Craig D Johnson, Letchworth (GB); Matthew R. Hackworth, Pearland, TX (US); Kian Rasa, Ithaca, NY (US); Christopher S. Del Campo, Houston, TX (US); Rod W. Shampine, Houston, TX (US); Claude J. Vercaemer, Paris (FR); Gerhard Schoonderbeek, Woking (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 157 days.

(21) Appl. No.: 10/632,174

(22) Filed: Jul. 31, 2003

(65) Prior Publication Data

US 2004/0104026 A1 Jun. 3, 2004

Related U.S. Application Data

(63) Continuation of application No. 10/021,724, filed on Dec. 12, 2001, now Pat. No. 6,695,054.

(60) Provisional application No. 60/400,162, filed on Oct. 15, 2002, provisional application No. 60/296,042, filed on Jun. 5, 2001, provisional application No. 60/286,155, filed on Apr. 24, 2001, provisional application No. 60/261,752, filed on Jan. 16, 2001.

(51) Int. Cl.
*E21B 43/10* (2006.01)

(52) U.S. Cl. ..... 166/207; 166/227

(58) Field of Classification Search ..... 166/228, 166/227, 236, 230, 278, 207, 381, 276

See application file for complete search history.

(56) References Cited

U.S. PATENT DOCUMENTS

| | | | |
|---|---|---|---|
| 261,252 | A | 7/1882 | Olmsted |
| 1,135,809 | A | 4/1915 | Jones |
| 1,229,437 | A | 6/1917 | Foster |
| 2,812,025 | A | 11/1957 | Teague et al. |
| 2,835,328 | A | 5/1958 | Thompson |
| 2,990,017 | A | 6/1961 | Powers |

(Continued)

FOREIGN PATENT DOCUMENTS

| | | |
|---|---|---|
| EP | 0 674 095 | 9/1995 |

(Continued)

OTHER PUBLICATIONS

Besselink, Peter; Biflex Stents; SMST-99: Proceedings of the First European Conference on Shape Memory and Superelastic Technologies, Antwerp Zoo, Belgium, 1999; pp. 142-150.

(Continued)

*Primary Examiner*—David Bagnell
*Assistant Examiner*—Daniel P Stephenson
(74) *Attorney, Agent, or Firm*—Robert A. Van Someren; Bryan P. Galloway; Jaime A. Castano

(57) ABSTRACT

An expandable device, such as a sand screen, is used in a wellbore. The expandable device comprises an expandable base pipe and a filter layer that facilitates expansion of the device while maintaining filtering capability.

12 Claims, 23 Drawing Sheets

U.S. PATENT DOCUMENTS

| | | | | |
|---|---|---|---|---|
| 3,297,092 | A | 1/1967 | Jennings | |
| 3,353,599 | A | 11/1967 | Swift | |
| 3,482,629 | A | 12/1969 | Suman, Jr. | |
| 4,064,938 | A * | 12/1977 | Fast | 166/236 |
| 5,348,095 | A | 9/1994 | Worrall et al. | |
| 5,366,012 | A | 11/1994 | Lohbeck | |
| 5,667,011 | A | 9/1997 | Gill et al. | |
| 5,901,789 | A | 5/1999 | Donnelly et al. | |
| 5,979,551 | A | 11/1999 | Uban et al. | |
| 6,012,522 | A | 1/2000 | Donnelly et al. | |
| 6,220,345 | B1 * | 4/2001 | Jones et al. | 166/51 |
| 6,263,966 | B1 | 7/2001 | Haut et al. | |
| 6,263,972 | B1 | 7/2001 | Richard et al. | |
| 6,315,040 | B1 | 11/2001 | Donnelly | |
| 6,412,565 | B1 | 7/2002 | Castano-Mears | |
| 6,415,509 | B1 | 7/2002 | Echols et al. | |
| 6,457,518 | B1 | 10/2002 | Castano-Mears et al. | |
| 6,457,533 | B1 | 10/2002 | Metcalfe | |
| 6,478,091 | B1 | 11/2002 | Gano | |
| 6,478,092 | B1 | 11/2002 | Voll et al. | |
| 6,488,702 | B1 | 12/2002 | Besselink | |
| 6,510,896 | B1 | 1/2003 | Bode et al. | |
| 6,530,431 | B1 | 3/2003 | Castano-Mears et al. | |
| 6,571,871 | B1 | 6/2003 | Lauritzen et al. | |
| 6,607,032 | B1 * | 8/2003 | Voll et al. | 166/227 |
| 6,619,401 | B1 * | 9/2003 | Echols et al. | 166/369 |
| 2002/0020524 | A1 | 2/2002 | Gano | |
| 2002/0046840 | A1 | 4/2002 | Schetky et al. | |
| 2002/0070031 | A1 | 6/2002 | Voll et al. | |
| 2002/0092648 | A1 | 7/2002 | Johnson et al. | |
| 2002/0092649 | A1 | 7/2002 | Bixenman et al. | |
| 2002/0092654 | A1 | 7/2002 | Coronado et al. | |
| 2002/0092658 | A1 | 7/2002 | Johnson et al. | |
| 2002/0107562 | A1 | 8/2002 | Hart et al. | |
| 2002/0121372 | A1 | 9/2002 | Cook et al. | |
| 2002/0144822 | A1 | 10/2002 | Hackworth | |
| 2002/0148612 | A1 | 10/2002 | Cook et al. | |
| 2003/0000709 | A1 | 1/2003 | Gano | |
| 2003/0034160 | A1 * | 2/2003 | Nguyen et al. | 166/278 |
| 2003/0056947 | A1 | 3/2003 | Cameron | |
| 2003/0089496 | A1 | 5/2003 | Price-Smith et al. | |

FOREIGN PATENT DOCUMENTS

| | | | |
|---|---|---|---|
| EP | 1152120 | A2 | 7/2001 |
| EP | 1167686 | A2 | 1/2002 |
| GB | 2370301 | A | 6/2002 |
| GB | 2371063 | A | 7/2002 |
| GB | 2403491 | A | 6/2003 |
| GB | 2374098 | B | 3/2005 |
| WO | WO 96/37680 | | 11/1996 |
| WO | WO 97/017524 | | 5/1997 |
| WO | WO 98/00626 | | 1/1998 |
| WO | WO 98/22690 | | 5/1998 |
| WO | WO 98/26152 | | 6/1998 |
| WO | WO 98/32412 | | 7/1998 |
| WO | WO 98/49423 | | 11/1998 |
| WO | WO 99/02818 | | 1/1999 |
| WO | WO 99/23354 | | 5/1999 |
| WO | 0188332 | A1 | 11/2001 |
| WO | 03023185 | A1 | 3/2003 |
| WO | 03100211 | A1 | 12/2003 |
| WO | WO 2004/014255 | | 2/2004 |

OTHER PUBLICATIONS

Docket Sheet for *Memry Corporation* v. *Kentucky Oil Technology, N.V.,* Case No. H-04-1959 (S.D. Tex.) (PACER Jun. 2, 2005) (5 pages).

Docket Sheet for *Memry Corporation* v. *Kentucky Oil Technology, N.V.,* Case No. C-04-03843, (N.D. Cal.) (PACER Aug. 11, 2005) (13 pages).

Communication from United States District Court Transferring Case, *Memry Corporation* v. *Kentucky Oil Technology, N.V.,* Case No. H-04-1959 (S.D. Tex.), dated Sep. 7, 2004 (1 page).

Plaintiffs' Original Complaint, *Memry Corporation* v. *Kentucky Oil Technology, N.V.,* Case No. H-04-1959, (S.D. Tex.), filed May 14, 2004 (20 pages).

Defendants' Motions (1) to Dismiss the Complaint for Insufficiency of Process and Lack of Personal Jurisdiction, (2) to Dismiss Counts I-III of the Complaint for Failure to State a Claim, and (3) in the Alternative, to Transfer This Action to the Federal District Court for the Northern District of California, *Memry Corporation* v. *Kentucky Oil Technology, N.V.,* Case No. H-04-1959, (S.D. Tex.), filed Jul. 7, 2004 (49 pages).

Plaintiff's First Amended Complaint, *Memry Corporation* v. *Kentucky Oil Technology, N.V.,* Case No. C-04-03843, (N.D. Cal.), filed Aug. 19, 2004 (20 pages).

Answer of Defendants and Counterclaims of Kentucky Oil Technology N.V. Against Memry Corporation and Schlumberger Technology Corporation, *Memry Corporation* v. *Kentucky Oil Technology, N.V.,* Case No. C-04-03843, (N.D. Cal.) filed Nov. 2, 2004 (20 pages).

Plaintiff and Counterdefendant Memry Corporation's Answer to Kentucky Oil Technology N.V.'s Counterclaims and Demand for Jury Trial, *Memry Corporation* v. *Kentucky Oil Technology, N.V.,* Case No. C-04-03843, (N.D. Cal.), filed Dec. 3, 2004 (10 pages).

Schlumberger Technology Corporation's Notice of Motion and Motion to Dismiss Kentucky Oil Technology's Third, Fourth, Fifth, and Sixth Counterclaims; and Memorandum of Points and Authorities, *Memry Corporation* v. *Kentucky Oil Technology, N.V.,* Case No. C-04-03843, (N.D. Cal.), filed Jan. 24, 2005 (32 pages).

[Proposed] Order Granting Schlumberger Technology Corporation's Motion to Dismiss Kentucky Oil Technology's Third, Fourth, Fifth, and Sixth Counterclaims, *Memry Corporation* v. *Kentucky Oil Technology, N.V.,* Case No. C-04-03843, (N.D. Cal.), filed Jan. 24, 2005 (3 pages).

First Amended Counterclaims of Kentucky Oil Technology N.V. Against Memry Corporation and Schlumberger Technology Corporation, *Memry Corporation* v. *Kentucky Oil Technology, N.V.,* Case No. C-04-03843, (N. D. Cal.), filed Feb. 9, 2005 (16 pages).

Schlumberger Technology Corporation's Notice of Motion and Motion to Dismiss Kentucky Oil Technology's First Amended Third, Fourth, Fifth, and Sixth Counterclaims; and Memorandum of Points and Authorities, *Memry Corporation* v. *Kentucky Oil Technology, N.V.,* Case No. C-04-03843, (N.D. Cal.), filed Feb. 24, 2005 (32 pages).

Request for Judicial Notice in Support of Schlumberger Technology Corporation's Motion to Dismiss Kentucky Oil Technology's First Amended Third, Fourth, Fifth, and Sixth Counterclaims, *Memry Corporation* v. *Kentucky Oil Technology, N.V.,* Case No. C-04-03843, (N.D. Cal.), filed Feb. 24, 2005 (3 pages).

[Proposed] Order Granting Schlumberger Technology Corporation's Motion to Dismiss Kentucky Oil Technology's First Amended Third, Fourth, Fifth, and Sixth Counterclaims, *Memry Corporation* v. *Kentucky Oil Technology, N.V.,* Case No. C-04-03843, (N.D. Cal.), filed Feb. 24, 2005 (3 pages).

Plaintiff and Counterdefendant Memry Corporation's Notice of Motion and Motion to Dismiss Kentucky Oil Technology's Third, Fourth, Fifth, and Sixth Counterclaims; and Memorandum of Points and Authorities, *Memry Corporation* v. *Kentucky Oil Technology, N.V.,* Case No. C-04-03843, (N.D. Cal.), filed Feb. 25, 2005 (29 pages).

Request for Judicial Notice in Support of Memry Corporation's Motion to Dismiss Kentucky Oil Technology's Third, Fourth, Fifth, and Sixth Counterclaims, *Memry Corporation* v. *Kentucky Oil Technology, N.V.,* Case No. C-04-03843, (N.D. Cal.), filed Feb. 25, 2005 (3 pages).

[Proposed] Order Granting Memry Corporation's Motion to Dismiss Kentucky Oil Technology's Third Fourth, Fifth, and Sixth Counterclaims, *Memry Corporation* v. *Kentucky Oil Technology, N.V.,* Case No. C-04-03843, (N.D. Cal.), filed Feb. 25, 2005 (3 pages).

Opposition of Kentucky Oil to Motions of Memry Corporation and Schlumberger Technology Corporation to Dismiss First Amended Counterclaims, *Memry Corporation* v. *Kentucky Oil Technology, N.V.,* Case No. C-04-03843, (N.D. Cal.), filed Mar. 11, 2005 (29 pages).

Kentucky Oil's Opposition to Counterdefendants' Requests for Judicial Notice in Support of Their Motions to Dismiss Kentucky Oil Technology's First Amended Third, Fourth, Fifth, and Sixth Counterclaims, *Memry Corporation* v. *Kentucky Oil Technology, N.V.,* Case No. C-04-03843, (N.D. Cal.), filed Mar. 11, 2005 (3 pages).

Plaintiff and Counterdefendant Memry Corporation's Reply in Support of Motion to Dismiss Kentucky Oil Technology's Third, Fourth, Fifth, and Sixth Counterclaims, *Memry Corporation* v. *Kentucky Oil Technology, N.V.,* Case No. C-04-03843, (N.D. Cal.), filed Mar. 18, 2005 (9 pages).

Plaintiff and Counterdefendant Memry Corporation's Reply in Support of Request for Judicial Notice, *Memry Corporation* v. *Kentucky Oil Technology, N.V.,* Case No. C-04-03843, (N.D. Cal.), filed Mar. 18, 2005 (4 pages).

Reply of Schlumberger Technology Corporation to Kentucky Oil Technology's Opposition to First Amended, Third, Fourth, Fifth, and Sixth Counterclaims, *Memry Corporation* v. *Kentucky Oil Technology, N.V.,* Case No. C-04-03843, (N.D. Cal.), filed Mar. 18, 2005 (17 pages).

Schlumberger's Response to Kentucky Oil's Opposition to Counterdefendants' Requests for Judicial Notice, *Memry Corporation* v. *Kentucky Oil Technology, N.V.,* Case No. C-04-03843, (N.D. Cal.), filed Mar. 18, 2005 (3 pages).

Schlumberger's Notice of Motion and Motion to Strike Exhibits 1, 2 and 4 to the Declaration of Nicola A. Pisano, *Memry Corporation* v. *Kentucky Oil Technology, N.V.,* Case No. C-04-03843, (N.D. Cal.), filed Mar. 18, 2005 (3 pages).

Kentucky Oil's Opposition to STC's Motion to Strike Exhibits 1, 3, and 4 to the Declaration of Nicola A. Pisano, *Memry Corporation* v. *Kentucky Oil Technology, N.V.,* Case No. C-04-03843, (N.D. Cal.), filed Mar. 25, 2005 (3 pages).

Kentucky Oil's Notice of Motion and Motion to Strike Declaration of Benjamin Holl and Portions of Counterdefendants' Reply Briefs, *Memry Corporation* v. *Kentucky Oil Technology, N.V.,* Case No. C-04-03843, (N.D. Cal.), filed Mar. 25, 2005 (4 pages).

[Proposed] Order Granting Kentucky Oil's Motion to Strike Declaration of Benjamin Holl and Portions of Counterdefendants' Reply Briefs, *Memry Corporation* v. *Kentucky Oil Technology, N.V.,* Case No. C-04-03843, (N.D. Cal.), entered Mar. 25, 2005 (2 pages).

Order Granting in Part and Denying in Part Counterdefendants' Motion to Dismiss, *Memry Corporation* v. *Kentucky Oil Technology, N.V.,* Case No. C-04-03843, (N.D. Cal.), entered Apr. 8, 2005 (26 pages).

Plaintiff and Counterdefendant Memry Corporation's Reply to Kentucky Oil Technology N.V.'s Counterclaims and Demand for Jury Trial, *Memry Corporation* v. *Kentucky Oil Technology, N.V.,* Case No. C-04-03843, (N.D. Cal.), filed Apr. 18, 2005 (8 pages).

Second Amended Counterclaims of Kentucky Oil Technology N.V. Against Memry Corporation and Schlumberger Technology Corporation, *Memry Corporation* v. *Kentucky Oil Technology, N.V.,* Case No. C-04-03843, (N.D. Cal.), filed May 6, 2005 (20 pages).

Plaintiff Memry Corporation's Reply to Kentucky Oil Technology N.V.'s Second Amended Counterclaims and Demand for Jury Trial, *Memry Corporation* v. *Kentucky Oil Technology, N.V.,* Case No. C-04-03843, (N.D. Cal.), filed Jun. 3, 2005 (9 pages).

Schlumberger Technology Corporation's Notice of Motion and Motion to Dismiss the Fourth, Fifth, Sixth, Seventh and Eighth Counterclaims in Kentucky Oil Technology's Second Amended Counterclaims, *Memry Corporation* v. *Kentucky Oil Technology, N.V.,* Case No. C-04-03843, (N.D. Cal.), filed Jun. 3, 2005 (18 pages).

Opposition of Kentucky Oil Technology to Schlumberger Technology Corporation's Motion to Dismiss Kentucky Oil's Second Amended Counterclaims, *Memry Corporation* v. *Kentucky Oil Technology, N.V.,* Case No. C-04-03843, (N.D. Cal.), filed Jun. 17, 2005 (16 pages).

Schlumberger Technology Corporation's Reply Brief in Support of its Motion to Dismiss the Fourth, Fifth, Sixth, Seventh and Eighth Counterclaims in Kentucky Oil Technology's Second Amended Counterclaims, *Memry Corporation* v. *Kentucky Oil Technology, N.V.,* Case No. C-04-03843, (N.D. Cal.), filed Jun. 24, 2005 (11 pages).

Order Granting in Part and Denying In Part STC's Motion to Dismiss, *Memry Corporation* v. *Kentucky Oil Technology, N.V.,* Case No. C-04-03843, (N.D. Cal.), entered Jul. 14, 2005 (8 pages).

Schlumberger Technology Corporation's Answer to Kentucky Oil Technology's Second Amended Counterclaims, *Memry Corporation* v. *Kentucky Oil Technology, N.V.,* Case No. C-04-03843, (N.D. Cal.), filed Jul. 28, 2005 (8 pages).

Notice o Motion and Motion by Kentucky Oil To Compel Production of Documents by Schlumberger Technology Corporation Pursuant to Fed. R. Civ. Rule 37; Memorandum of Points and Authorities in Support Thereof; Declaration of Michael Bierman, *Memry Corporation* v. *Kentucky Oil Technology, N.V.,* Case No. C-04-03843, (N.D. Cal.), filed Jul. 28, 1005 (32 pages).

Schlumberger Technology Corporation's Opposition to Kentucky Oil Technology's Motion to Compel, *Memry Corporation* v. *Kentucky Oil Technology, N.V.,* Case No. C-04-03843, (N.D. Cal.), filed Aug. 4, 2005 (21 pages).

Declaration of David B. Moyer in Support of Schlumberger Technology Corporation's Opposition to Kentucky Oil Technology's Motion to Compel, *Memry Corporation* v. *Kentucky Oil Technology, N.V.,* Case No. C-04-03843, (N.D. Cal.), filed Aug. 4, 2005 (52 pages).

Kentucky Oil's Reply in Support of Motion to Compel, *Memry Corporation* v. *Kentucky Oil Technology, N.V.,* Case No. C-04-03843, (N.D. Cal.), filed Aug. 10, 2005 (18 pages).

Declaration of Nicola A. Pisano in Support of Kentucky Oil's Motion to Compel, *Memry Corporation* v. *Kentucky Oil Technology, N.V.,* Case No. C-04-03843, (N.D. Cal.), filed Aug. 10, 2005 (69 pages).

Order Granting Kentucky Oil's Motion to Compel Production of Documents, *Memry Corporation* v. *Kentucky Oil Technology, N.V.,* Case No. C-04-03843, (N.D. Cal.), entered Aug. 17, 2005 (8 pages).

US 6,706,063, 03/2004, Besselink (withdrawn)

* cited by examiner

EXPANDABLE SYSTEMS THAT FACILITATE DESIRED FLUID FLOW

CROSS-REFERENCE TO RELATED APPLICATIONS

The following is based on and claims priority to Provisional Application No. 60/400,162, filed Oct. 15, 2002, and is a continuation of patent application Ser. No. 10/021,724, filed Dec 12, 2001 now U.S. Pat. No. 6,695,054, which was based on and claimed the priority of Provisional Application No. 60/261,752, filed Jan 16, 2001, Provisional Application No. 60/286,155, filed Apr. 24, 2001, and Provisional Application No. 60/296,042, filed Jun. 5, 2001.

BACKGROUND

A variety of systems are utilized in facilitating the production of fluids from subterranean environments. In some applications, certain solid particles are filtered from a fluid flow to enhance production of the desired fluid. For example, sand screen designs are utilized in wellbores drilled to facilitate the production of hydrocarbon-based fluids. Typically, the sand screen has a tubular configuration and is inserted into the wellbore and deployed at a desired location. Openings through the sand screen permit the flow of fluid from the surrounding formation into an interior of the sand screen for movement to a desired collection point or other location. Such filtering devices are comprised of one or more layers that permit fluid flow therethrough. In some designs, the screen may comprise an expandable tubular. Also, the flow of fluid into a wellbore may be segregated into zones by, for example, packers deployed along the screen.

SUMMARY

The present invention relates to expandable systems that may be utilized, for example, in a wellbore drilled into a subterranean formation. The expandable systems are designed to improve or otherwise facilitate certain flow characteristics by, for example, filtering and/or zonal isolation.

BRIEF DESCRIPTION OF THE DRAWINGS

Certain embodiments of the invention will hereafter be described with reference to the accompanying drawings, wherein like referenced numerals denote like elements, and.

DETAILED DESCRIPTION

Figure 1:
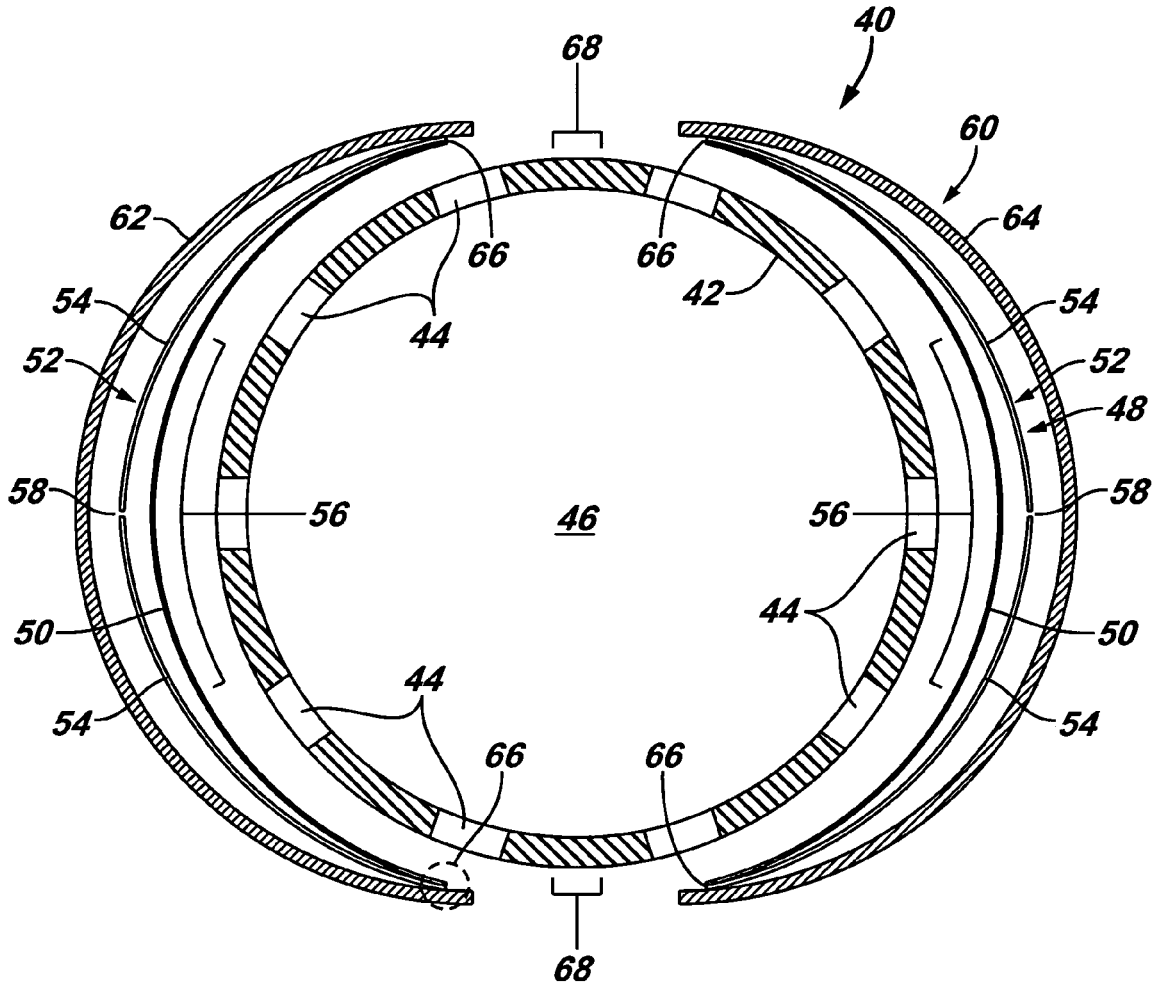
FIG. 1 is a schematic illustration of an expandable filtering device, according to an embodiment of the present invention.

Referring generally to FIG. 1, an expandable filtration device 40, such as an expandable sand screen for use in a wellbore, is illustrated. In the embodiment illustrated, expandable device 40 comprises a base pipe 42. Base pipe 42 as a plurality of openings 44 extending generally radially from an interior 46 of base pipe 40 to the exterior region surrounding base pipe 42. Base pipe 42 may be formed from a metal material, such as a steel suitable for use in a wellbore environment. The openings 44 formed through base pipe 42 may be made in a variety of shapes, sizes and configurations, including the formation of such openings as bistable cells.

Base pipe 42 cooperates with a filter 48 to remove particulate matter in fluids flowing from a surrounding geological formation through filter 48 and into the interior 46 of base pipe 42. In one embodiment, filter 48 may comprise a base filter layer 50 and a separable filter layer 52. In this embodiment, base filter layer 50 is separated into two halves, and the separable filter layer 52 is divided into four sections in which pairs of sections extend toward one another without overlapping. By way of example, base filter layer 50 is perforated, while separable filter layer 52 is a woven filter. However, base filter layer 50 includes a region 56 having no perforations. Region 56 prevents the influx of particulates through openings 44 when device 40 is expanded, separating the pairs of sections 54 to increase the size of a gap 58 disposed between the sections of woven filter.

Although filter 48 and can be used in cooperation with base pipe 42 in a variety of ways, including externally and internally, the illustrated embodiment demonstrates the use of filter 48 along an exterior surface of base pipe 42, such that filter 48 substantially surrounds base pipe 42. In this example, filter 48 is held in position around base pipe 42 by a perforated shroud 60. Shroud 60 is divided into two shroud sections 62, 64 to which the sections of filter 48 are attached. For example, one half of base filter layer 50 and two sections 54 of separable filter layer 52 may be attached to shroud section 62, e.g. by welding, at a pair of attachment regions 66. Attachment regions 66 are set back a desired distance from the ends of shroud section 62 to enable attachment of shroud section 62 to base pipe 42 by, for example, welding at a weld region 68. Similarly, the other half of base filter 50 and the other two sections 54 of separable filter layer 52 may be similarly attached to shroud section 64. Shroud section 64, in turn, is affixed to base pipe 42 at region 68. In this embodiment, separable filter layer 52 is disposed between base filter layer 50 and perforated shroud 60. Also, each of the separable filter layer sections 54 extends from the attachment regions 66 toward gap 58. Thus, the size of each gap 58 increases when device 40 is expanded, but each expanded gap 58 is covered by the nonperforated region 56 of base filter layer 52 to block the inflow of sand through this region.

Figure 2:
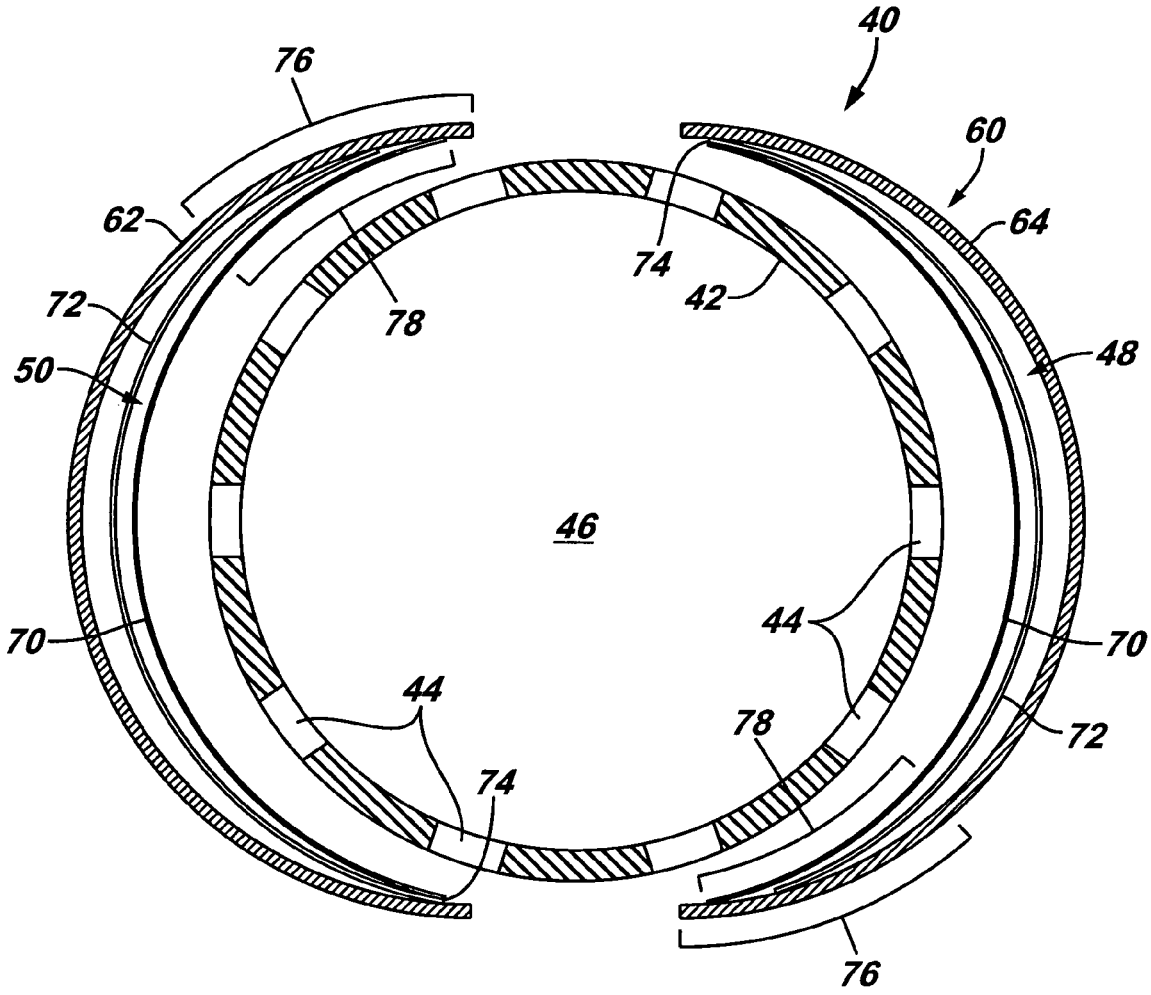
FIG. 2 is another embodiment of the filtering device illustrated in FIG. 1.

In the embodiment of expandable device 40 illustrated in FIG. 2, base filter layer 50 and separable filter layer 52 each comprise pairs of single sheet sections 70, 72, respectively. One pair of sheet sections 70, 72 is affixed to shroud section 62 at an attachment region 74, e.g. by welding the sheet sections to the shroud. The other pair of sheet sections 70, 72 is attached to shroud section 64 at another attachment region 74, as illustrated. The ends of sheet sections 70, 72 opposite attachment region 74 are free to slide as the expandable device 40 is expanded. Accordingly, perforated shroud 60 may comprise nonperforated region 76 adjacent the sliding ends of single sheet sections 70 and 72. In the illustrated embodiment, each shroud section 62, 64 comprises a nonperforated region 76 to prevent the influx of particulates in that region after expansion of device 40. Alternatively or in addition to nonperforated regions 76, base filter 50 also may comprise nonperforated regions 78 disposed proximate each unattached, sliding end of separable filter layer 52. Thus, when device 40 is expanded, nonperforated regions 76 and/or nonperforated regions 78 limit the influx of particulates from the surrounding formation into the interior 46 of base pipe 42.

Figure 3:
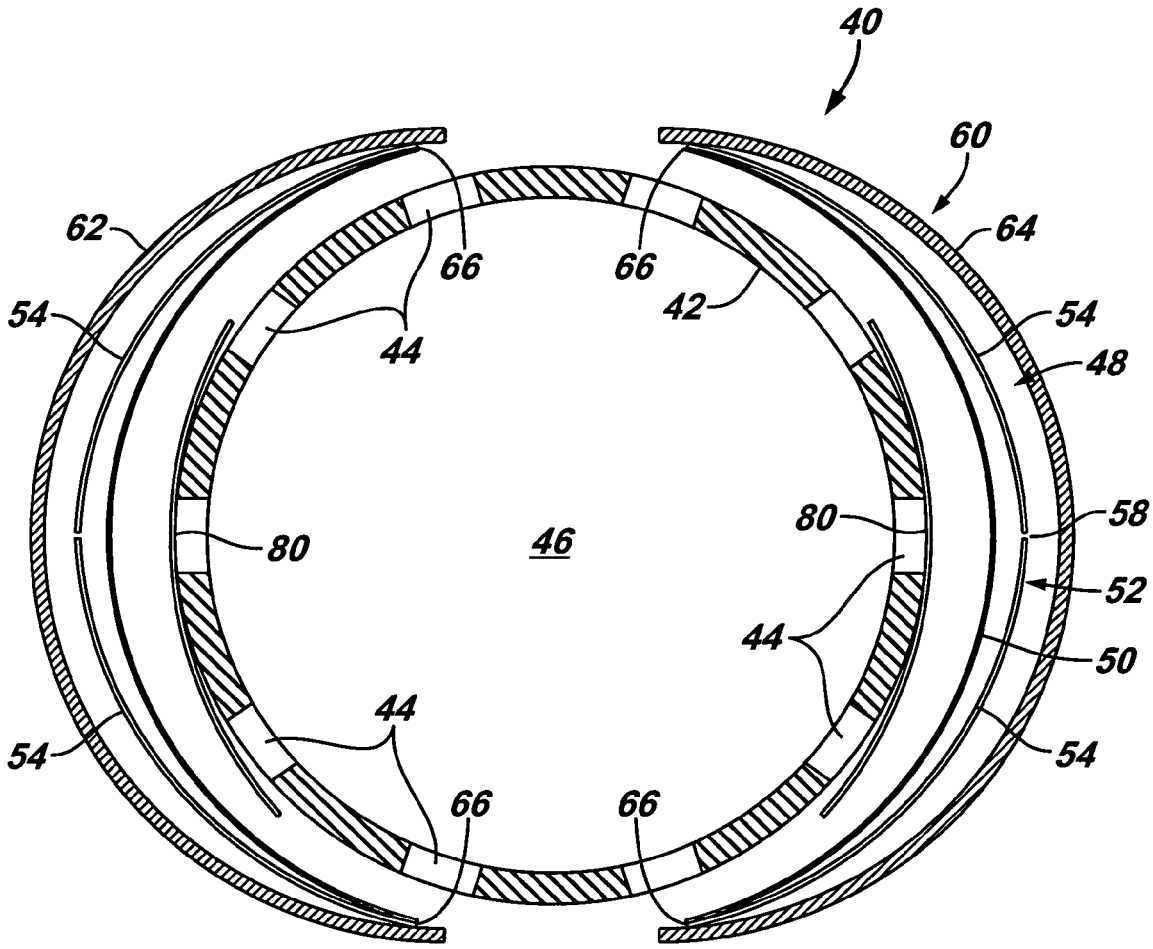
FIG. 3 is another embodiment of the filtering device illustrated in FIG. 1.

Another embodiment of expandable device 40 is illustrated in FIG. 3. In this embodiment, the base filter layer 50 and separable filter layer 52 are arranged similarly to that illustrated and described with reference to FIG. 1. However, an additional shut-off layer 80 is deployed at each gap 58. For example, layer 80 may comprise a pair of solid sections 82 deployed between base filter layer 50 and base pipe 42 in the region over which gap 58 expands. Thus, upon expansion of device 40, particulate flow through gap 58 is blocked by layer 80. The use of layer 80 enables the formation of base filter layer 50 without the use of any solid, nonperforated regions. Layer 80 also can be formed as a sealed filter layer that eventually opens to permit filtration once device 40 has been deployed and expanded within a wellbore.

Figure 4:
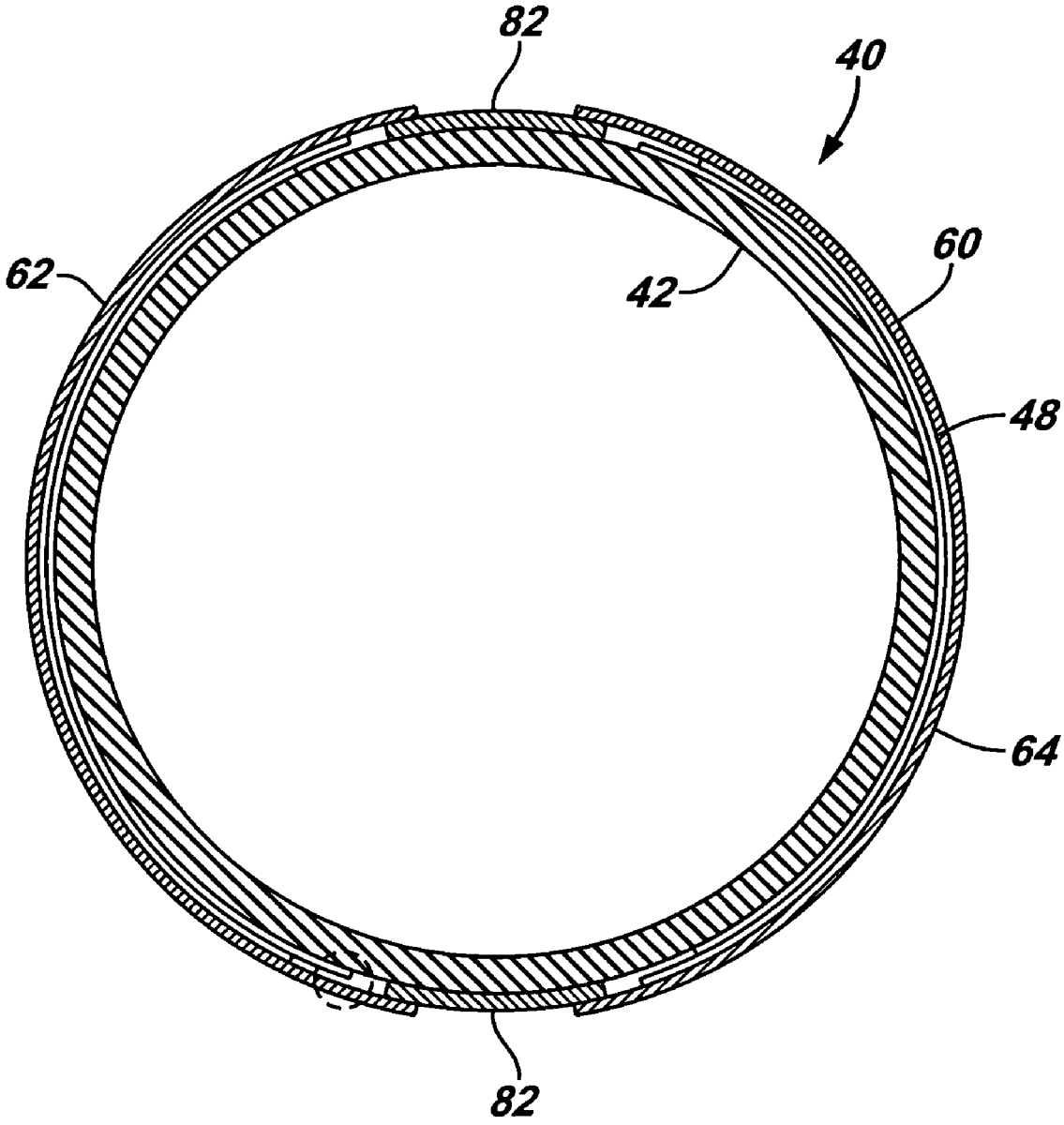
FIG. 4 is another embodiment of the filtering device illustrated in FIG. 1.
Figure 5:
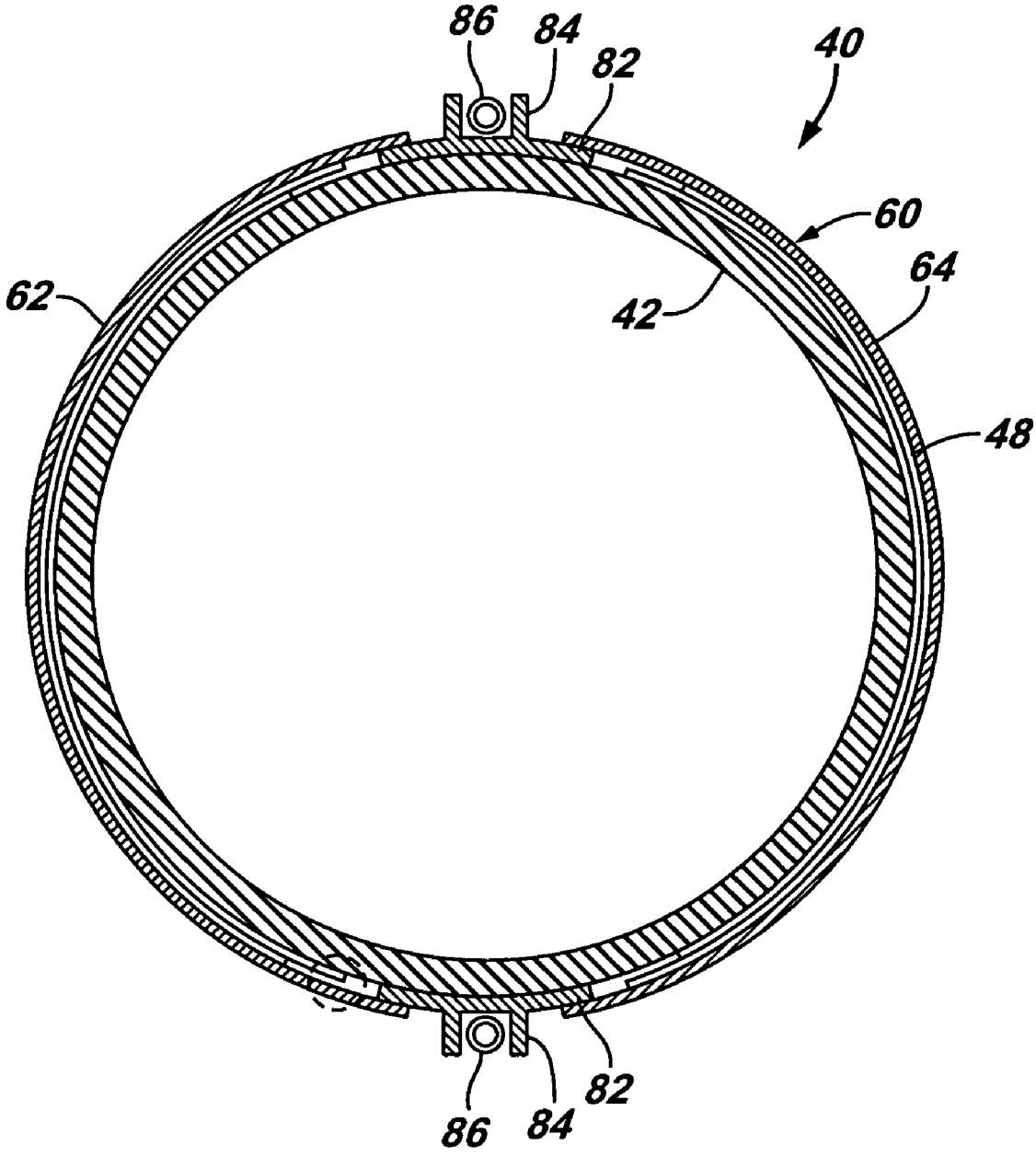
FIG. 5 is another embodiment of the filtering device illustrated in FIG. 1.

Referring generally to FIG. 4, another embodiment of expandable device 40 is illustrated. In this embodiment, base pipe 42 is surrounded by filter 48 and shroud 60. However, shroud 60 is attached to base pipe 42 via a backing strip 82. By way of example, shroud sections 62 and 64 may each be attached to a pair of backing strips 82. The backing strips 82 may be fastened to the base pipe 42 by fasteners (not shown), such as rivets, screws, pins, or other appropriate fasteners. The backing strips 82 also can be welded to base pipe 42, but the use of fasteners can simplify the construction of expandable device 42. Shroud sections 62, 64 are attached to the backing strips 82 by, for example, welding or other fastening mechanisms. The filter 48 may comprise a variety of filter layers, filter types and filter configurations, including those discussed above with reference to FIGS. 1, 2 and 3. Also, backing strips 82 may comprise other features, such as a channel 84, as illustrated best in FIG. 5. Each backing strip 82 may have one or more channels 84 that can be used, for example, to route control lines 86, such as fiber-optic lines, electrical lines, hydraulic lines or other types of control lines along the expandable device. Also, backing strips 82 may be made, for example, from "weld friendly" materials, such as 316 stainless steel or 825 high nickel alloy.

Figure 6:
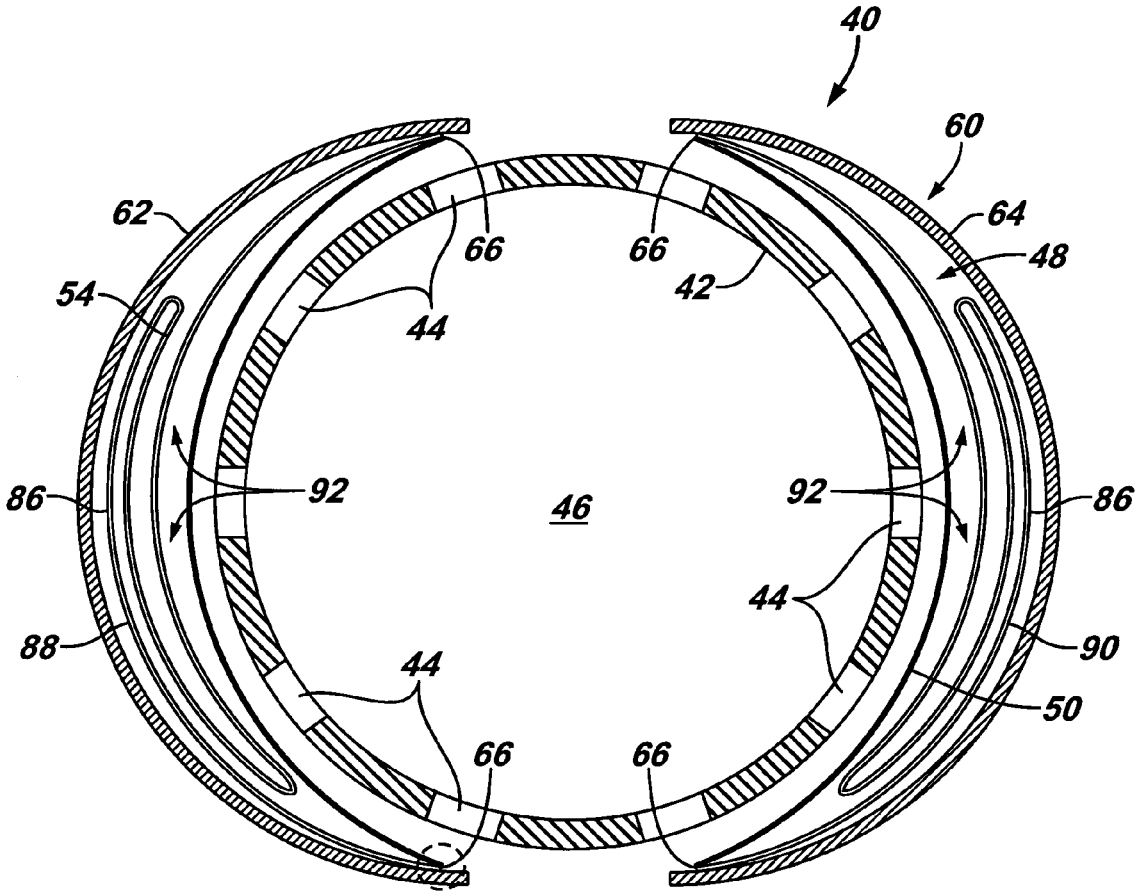
FIG. 6 is another embodiment of the filtering device illustrated in FIG. 1.

In FIG. 6, another embodiment of expandable filtration device 40 is illustrated. In this embodiment, filter 48 comprises a pleated filter layer 86. Pleated filter layer 86 may be divided into sections, such as sections 88 and 90 corresponding to shroud sections 62 and 64. Generally, pleated filter layer 86 comprises one or more pleated regions 92 in which the pleated filter layer 86 is folded back on itself to provide sufficient material to accommodate the expansion of device 40.

Figure 7:
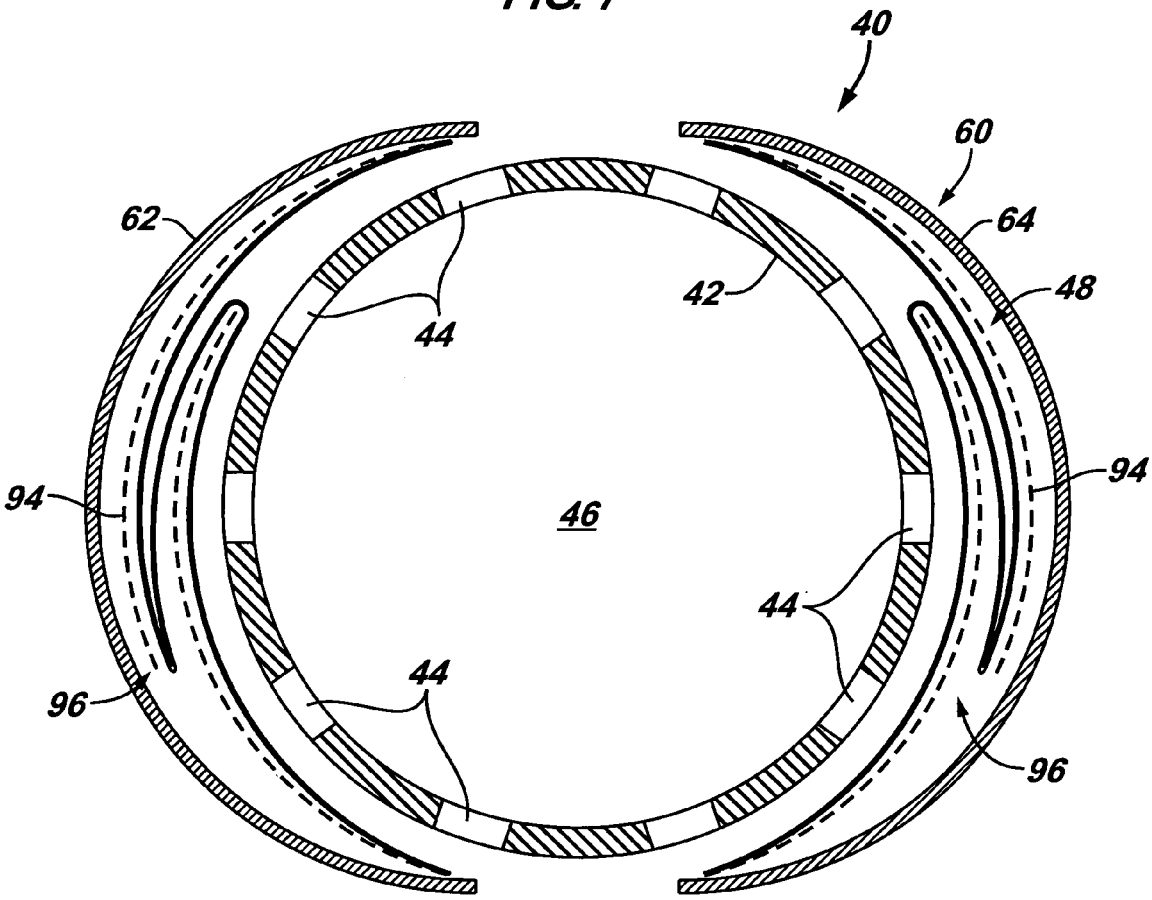
FIG. 7 is another embodiment of the filtering device illustrated in FIG. 1.

Pleated filter layer 86 can be used alone or in combination with a variety of other types of filter layers, such as the base filter 50, illustrated in FIG. 6. Alternatively, the pleated filter layer can be laminated with a variety of other layers 94 to form, for example, a laminated single filter layer 96, as illustrated in FIG. 7.

Figure 8:
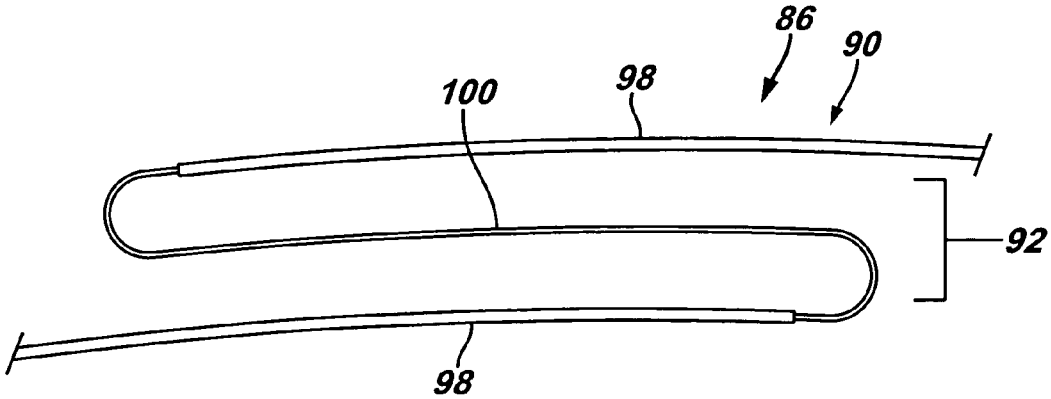
FIG. 8 illustrates an example of a multi-section filter, according to an embodiment of the present invention.

The construction of a pleated filter layer 86 or filter layer section, such as pleated filter section 90, can be accomplished in a variety of ways. In FIG. 8, for example, an embodiment is illustrated in which the pleated filter section is formed by a pair of primary filter sections 98 coupled by a connecting filter section 100 that is folded back on itself to create the pleated region 92. In this example, primary filter sections 98 are durable sections designed to stop long-term sanding, and those durable sections are connected by section 100 which is generally a compliant section that allows the required bending and rolling of the material during expansion of expandable device 42. However, connecting section 100 also serves as a filter to stop the inflow of particulates between primary filter sections 98.

Figure 9:
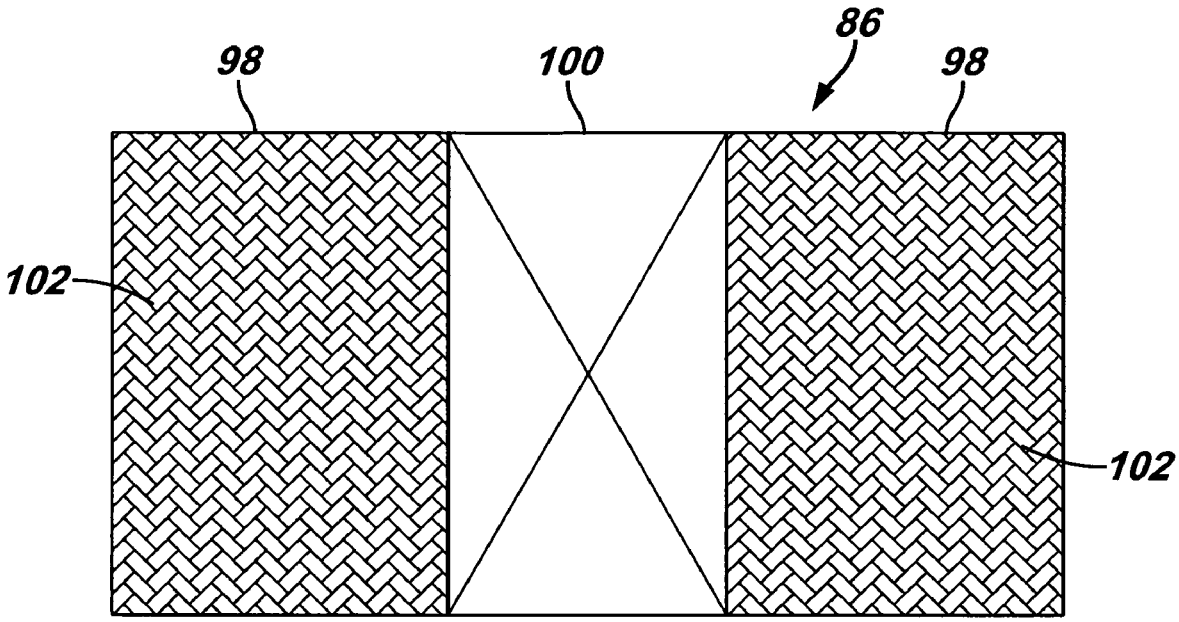
FIG. 9 illustrates another embodiment of the multi-section filter of FIG. 8.
Figure 10:
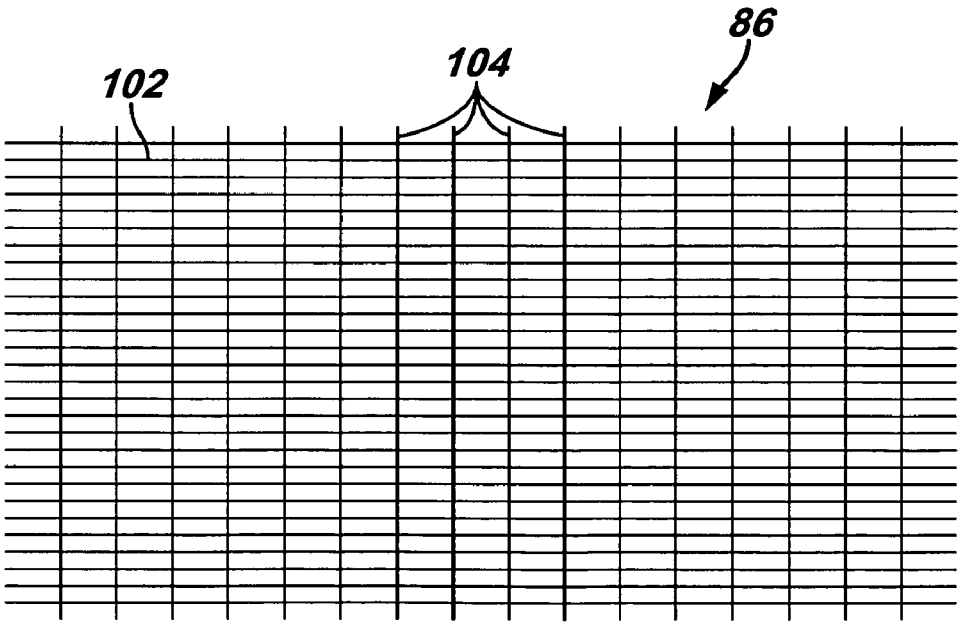
FIG. 10 illustrates another embodiment of the multi-section filter of FIG. 8.
Figure 11:
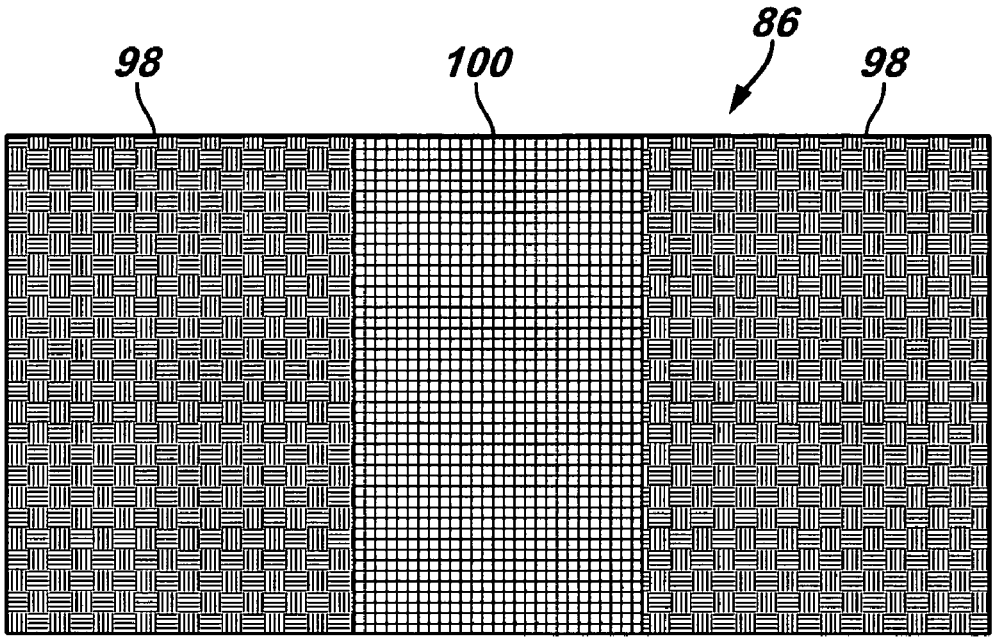
FIG. 11 illustrates another embodiment of the multi-section filter of FIG. 8.
Figure 12:
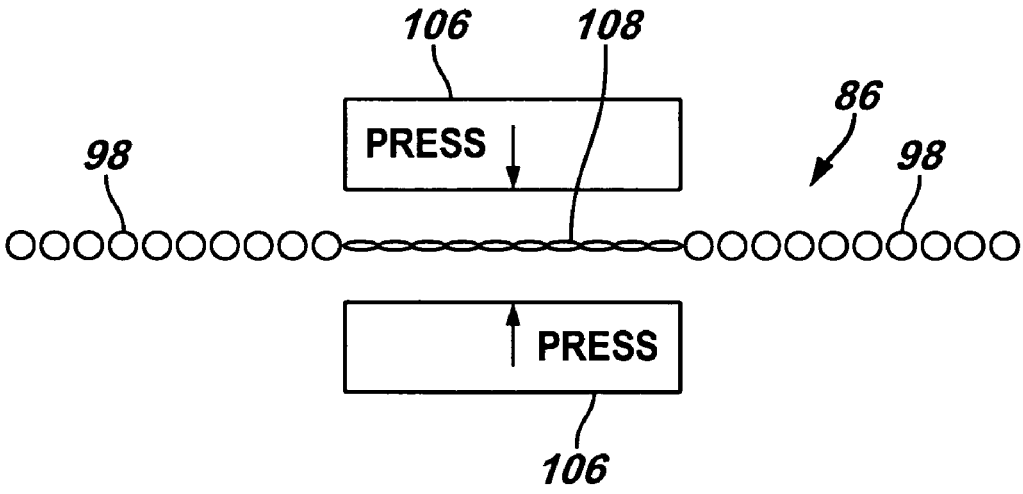
FIG. 12 illustrates another embodiment of the multi-section filter of FIG. 8.

Referring generally to FIGS. 9 through 14, a variety of pleated filters are illustrated. In FIG. 9, for example, primary filter sections 98 are formed from a single layer of woven material 102, while connecting section 100 is a pliable section that accommodates pleating of the overall filter sheet. In the embodiment illustrated in FIG. 10, connecting section 100 also comprises a woven material, e.g. woven material 104. Woven material 104 may have a smaller diameter thread, a different weave configuration or a different material, such as a polymer or composite. For example, connecting section 100 may have a reduced weave density, such as the embodiment illustrated in FIG. 11 where primary filter sections 98 are densely woven and connecting section 100 is sparsely woven relative to primary sections 98. Alternatively, connecting section 100 may initially be woven similarly to primary filter sections 98. However, the connecting section 100 is rolled or pressed by an appropriate press 106 into a compressed section 108, as illustrated in FIG. 12. Effectively, compressed section 108 is a weakened connecting section 100 with enhanced rolling capabilities. In this example, pleated filter layer 86 is formed from a single woven filter sheet having a connecting section 100 compressed to enhance its flexibility.

Figure 13:
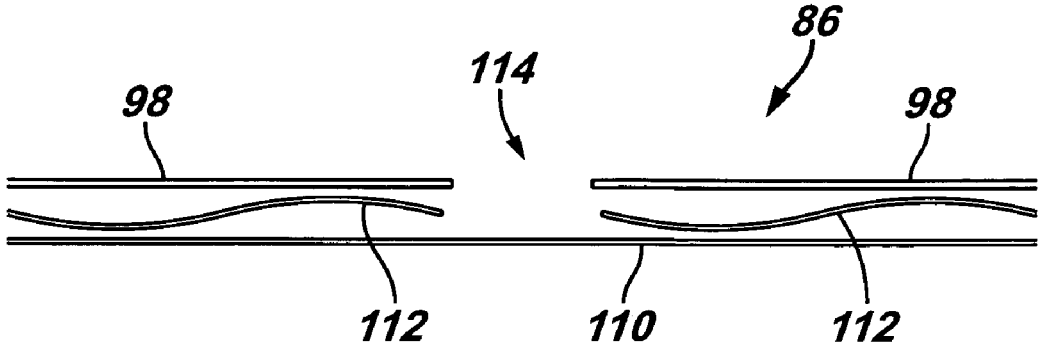
FIG. 13 illustrates an example of a laminated filter, according to an embodiment of the present invention.
Figure 14:
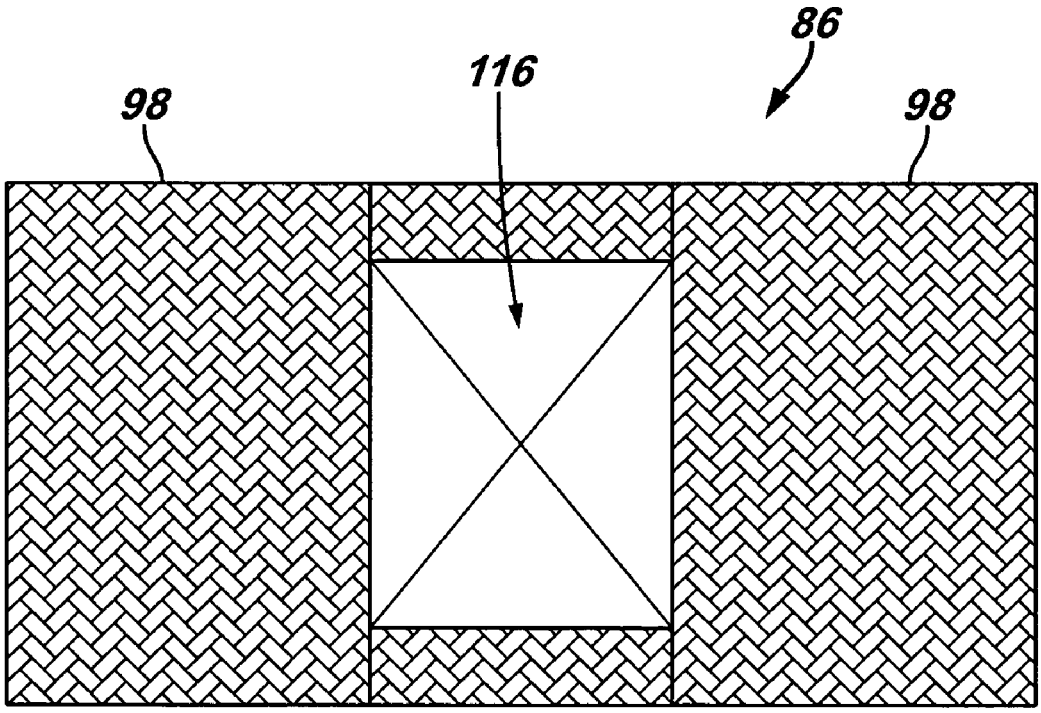
FIG. 14 illustrates another embodiment of the multi-section filter of FIG. 8.

The pleated filter layer 86 also can be formed as a laminated single filter layer, as illustrated in FIG. 13. For example, woven primary filter sections 98 can be affixed to a substrate layer 110 by an adhesive 112 or other suitable connection medium. The primary filter sections 98 are attached to substrate 110 with a linear gap 114 therebetween. The substrate material in gap 114 serves as connecting section 100. Thus, substrate material 110 is selected with sufficient flexibility to permit the pleating of substrate 110 in the linear gap region formed between primary filter sections 98. It should be noted that although filter sections 98 are described as woven filter sections with reference to FIG. 13, the filter sections 98 can be formed from other types of filter materials. In another embodiment, illustrated in FIG. 14, the pleated filter section is formed as a single continuous filter, such as a woven filter, with an interior flexible zone 116. Interior flexible zone 116 may be formed from a flexible material, such as a thin perforated sheet material.

In the latter design, as well as the designed illustrated in FIGS. 6 through 13, the pleated filter sheet can be woven as a single woven metal sheet with the connecting filter area having a reduced wire count, wire diameter or other change in the weave configuration. Also, the pleated filter sheet can be constructed by joining three individual sheets, such as separate primary filter sheets and a separate middle connecting sheet. The sheets can be joined by a variety of mechanisms, such as a metallurgical weld or an adhesive. Also, the connecting section 100 can be formed from a variety of materials, including weak metal wire cloth, a woven fabric of Kevlar or other fibers, a polymer sheet, a thin metallic sheet, or a variety of composite or other materials that provide the desired flexibility and rolling qualities to enable expansion of the overall filtration device 40 without damaging the filter layers. The examples listed are just a few examples of materials and material constructions that can be utilized in creating a pleated filter sheet.

Figure 15:
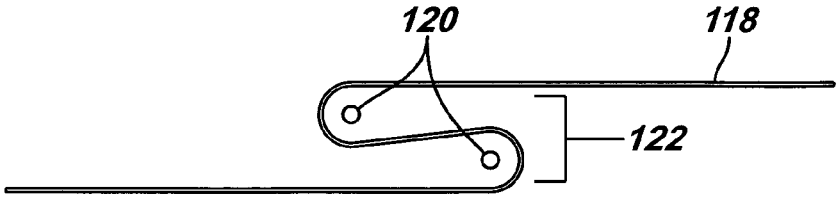
FIG. 15 illustrates a filter incorporating rollers, according to an embodiment of the present invention.
Figure 16:
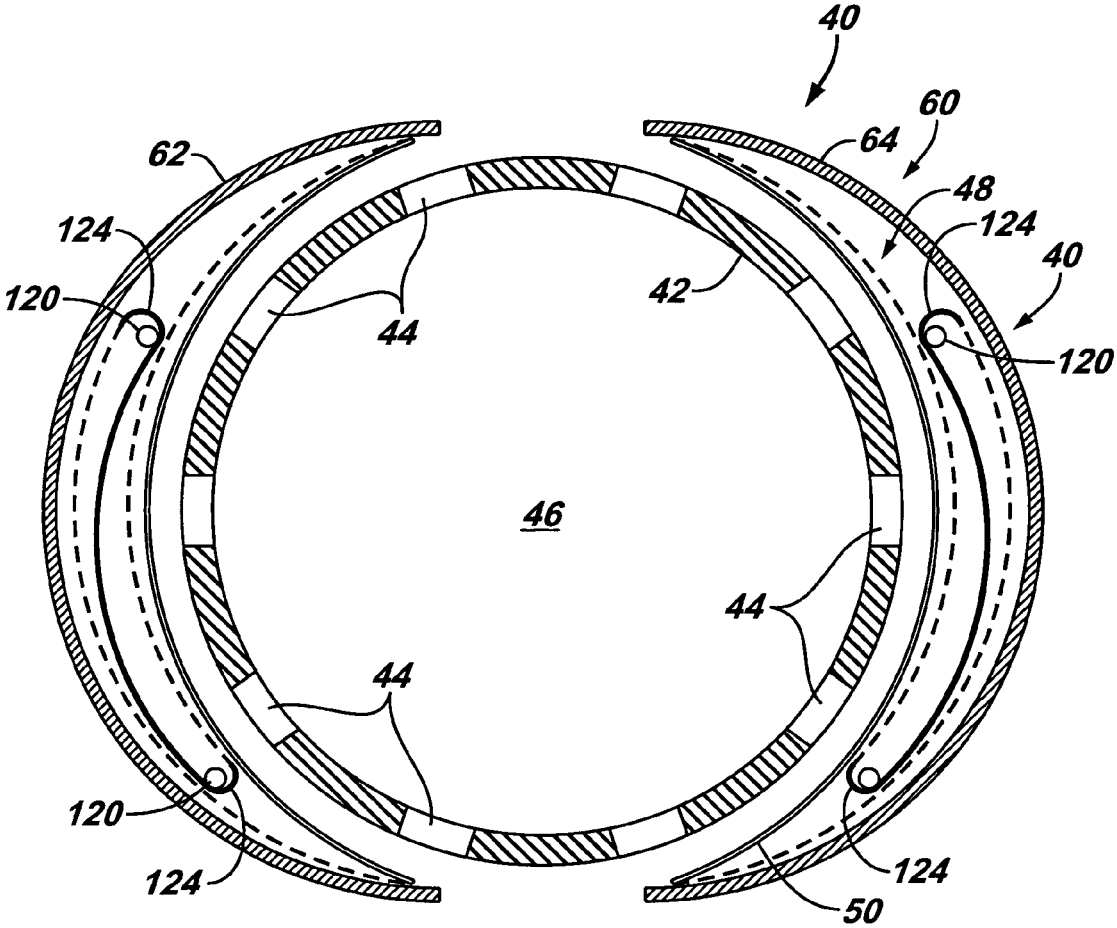
FIG. 16 illustrates another example of a filter utilizing rollers.

Referring generally to FIG. 15, the expandability of a given filter sheet 118 can be enhanced with the use of one or more rollers 120. For example, a pair of elongated rollers 120 can be disposed in a folded or pleated region 122 of filter sheet 118. The rollers 120 reduce the friction between the pleats of the filter sheet 118 as sheet 118 is stretched to a more elongated configuration. Also, at least one of the rollers 120 may have a hollow interior to receive a control line. In FIG. 16, an embodiment similar to that illustrated in FIG. 6 includes rollers 120 disposed in pleats 124 of pleated filter layer 86. In the specific example illustrated, two elongated rollers 120 are deployed in the pleats of each pleated filter section 90 to facilitate the transition of pleated filter layer 86 from a contracted state to an expanded state as the base pipe 42 and overall device 40 are expanded within a wellbore.

Figure 17:
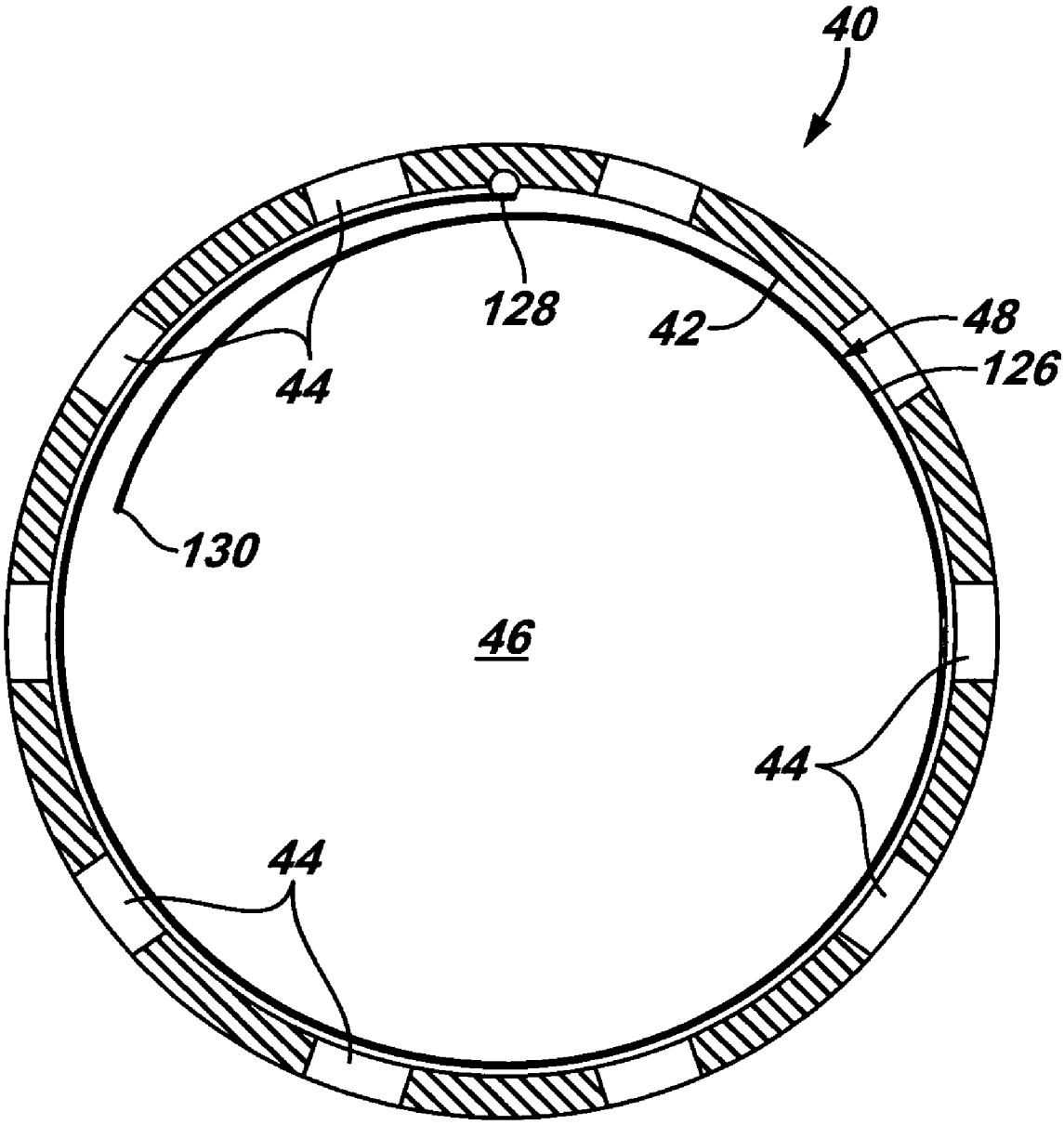
FIG. 17 illustrates another example of an expandable filtering device, according to an embodiment of the present invention.

With reference to FIG. 17, another embodiment of expandable device 40 is illustrated. In this embodiment, a filter layer 126 is deployed in the interior 46 of base pipe 42. Filter layer 126 may be formed from a woven filter material or other suitable filter material. In this example, filter layer 126 comprises a single sheet coiled along the anterior surface of base pipe 42. The filter layer 126 is connected to base pipe 42 along a first edge 128 extending longitudinally along the interior of base pipe 42. The filter layer 126 is coiled upon itself such that a second edge 130 overlaps first edge 128. First edge 128 may be attached to base pipe 42 by a weldment or other suitable attachment mechanism. The overlap of second edge 130 with first edge 128 is sufficient to accommodate expansion of base pipe 42 without creating a gap between first edge 128 and second edge 130.

Figure 18:
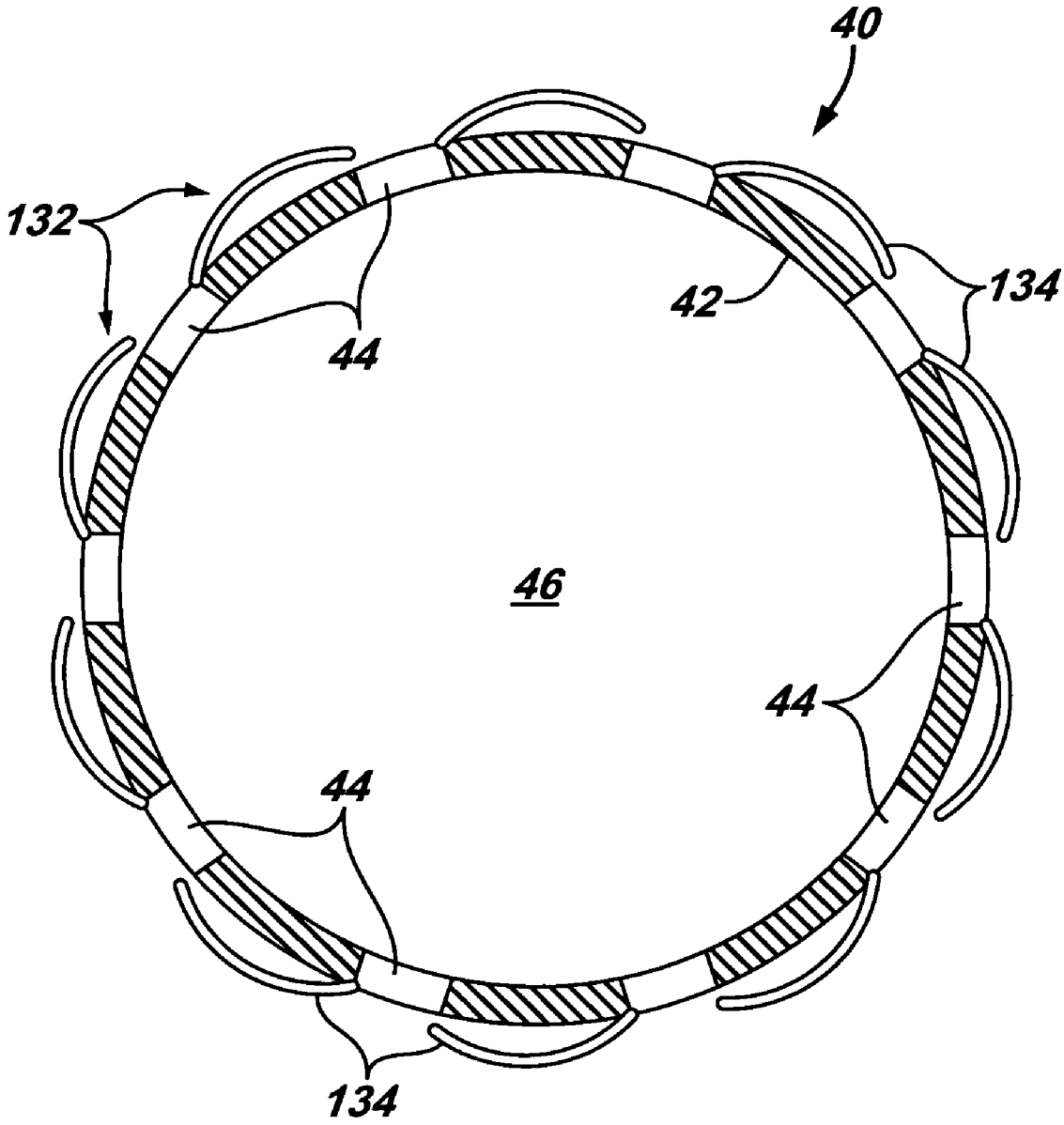
FIG. 18 illustrates another example of an expandable filtering device utilizing a plurality of individual filter sections, according to an embodiment of the present invention.
Figure 19:
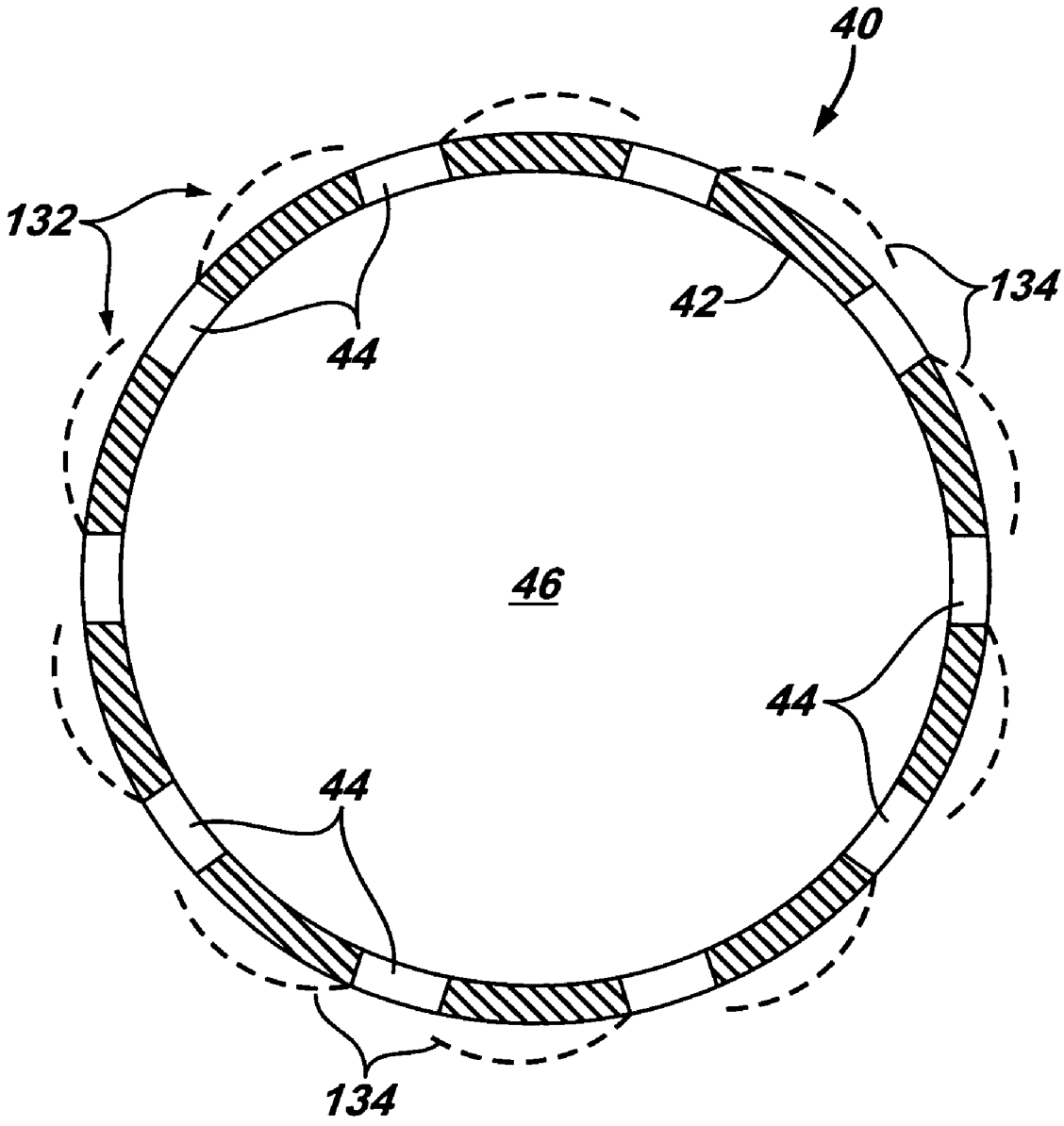
FIG. 19 illustrates another embodiment of the expandable filtering device illustrated in FIG. 18.

Another embodiment of expandable device 40 is illustrated in FIG. 18. In this embodiment, a filter layer 132 is created by attaching multiple filter sections 134 to specific locations along base pipe 42. The multiple filter sections 134 are attached such that openings 44 of base pipe 42 are exposed when in the contracted state illustrated in FIG. 18. However, when base pipe 42 of expandable device 40 is radially expanded, the multiple filter sections 134 are shifted to cover openings 44, thereby filtering particulates before they enter the interior 46 of base by 42. Typically, each of the multiple filter sections 134 is attached along one edge while the opposing edge remains free. By properly attaching the first adage, the filter section transitions over the opening 44, or the opening 44 moves beneath the filter section upon expansion. The exact point of attachment of each filter section 134 will vary with the size, spacing and configuration of openings 44. Alternatively, the multiple filter sections 134 may be made of sufficient length to effectively cover the service area of expandable base pipe 42, as illustrated in FIG. 19. In this embodiment, the multiple filter sections 134 are disposed over corresponding openings 44 when in the contracted and the expanded state.

Figure 20:
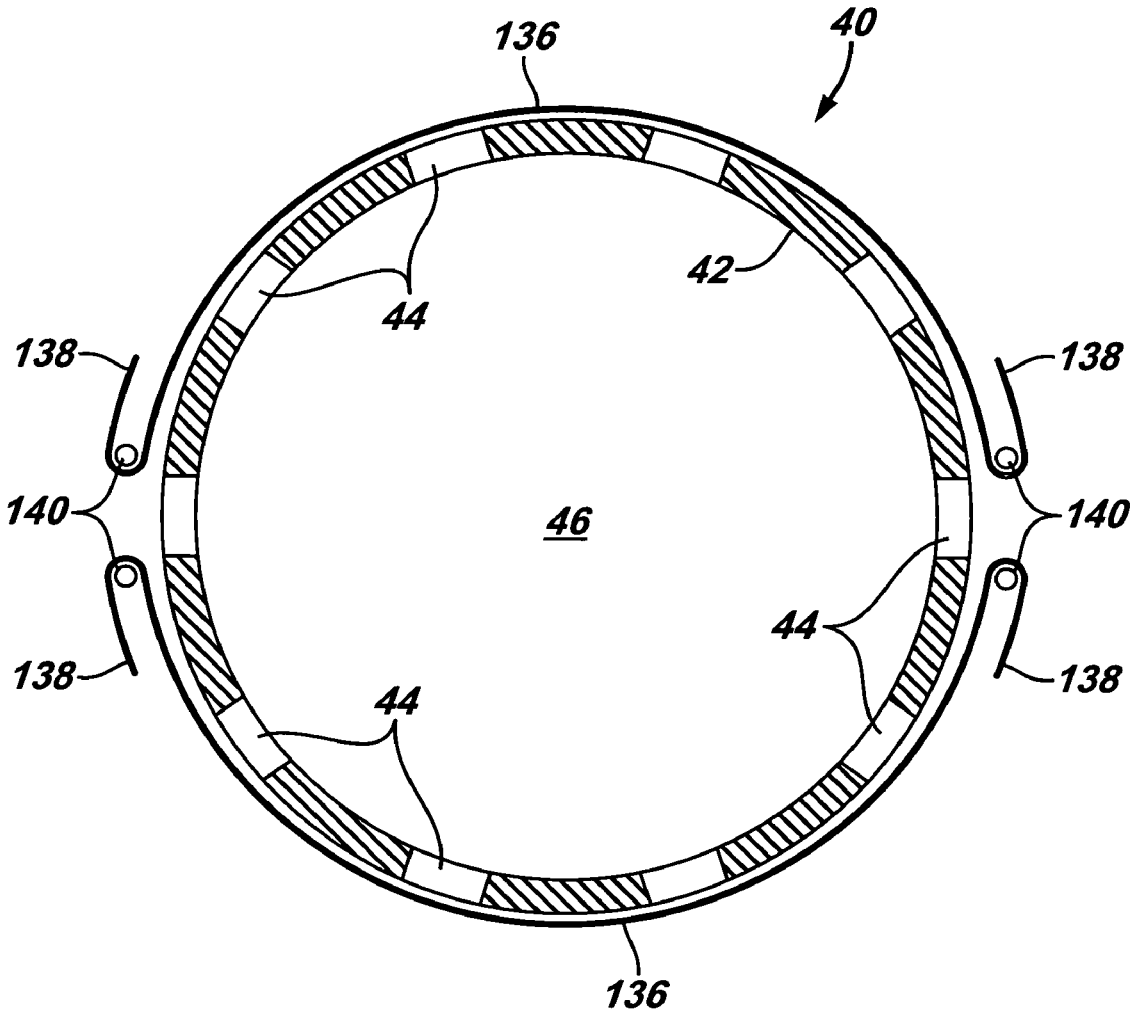
FIG. 20 illustrates another example of a filter utilizing rollers.

As illustrated in FIG. 20, excess filter material may be stored to enable expansion of expandable device 40 without damaging filter layers. For example, one or more filter sections 136 may have excess filter material 138 stored at the circumferential ends of each filter section 136. The excess filter material 138 may, for example, be coiled about rollers 140. Rollers 140 are deployed longitudinally along base pipe 42 and are used to roll a sufficient amount of excess filter material 138 to fully accommodate expansion of base pipe 42 in a given wellbore. The rollers 140 may be rotatably mounted to base pipe 42 or other features of or near expandable device 40. Depending on the type of material used in forming filter sections 136, rollers 140 potentially can be replaced with pins around which the excess filter material 138 slides as device 40 is expanded.

Figure 21:
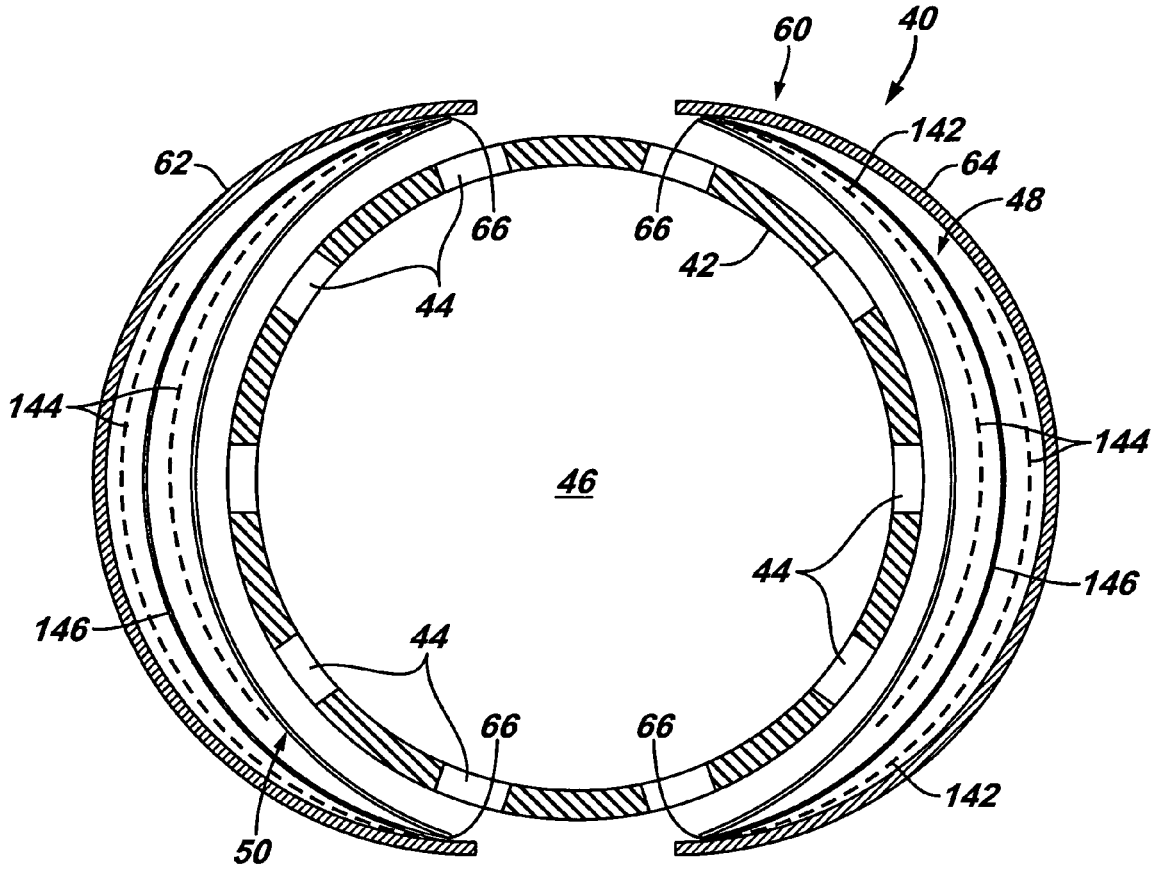
FIG. 21 illustrates another example of an expandable filtering device, according to an embodiment of the present invention.

In another embodiment illustrated in FIG. 21, a filter sheet 142 may be formed with excess filter material 144 deployed in an overlapping configuration, as illustrated. In this embodiment, a liner 146 is deployed between pairs of filter sheets to facilitate the relative sliding of excess filter material 144 during expansion of the overall device 40. In the example illustrated in FIG. 21, the overall design of device 40 is similar to that described with reference to FIG. 1. However, the separable filter layer 52 of FIG. 1 has been replaced with the combination of overlapping filter sheets 142 and liner 146.

Figure 22:
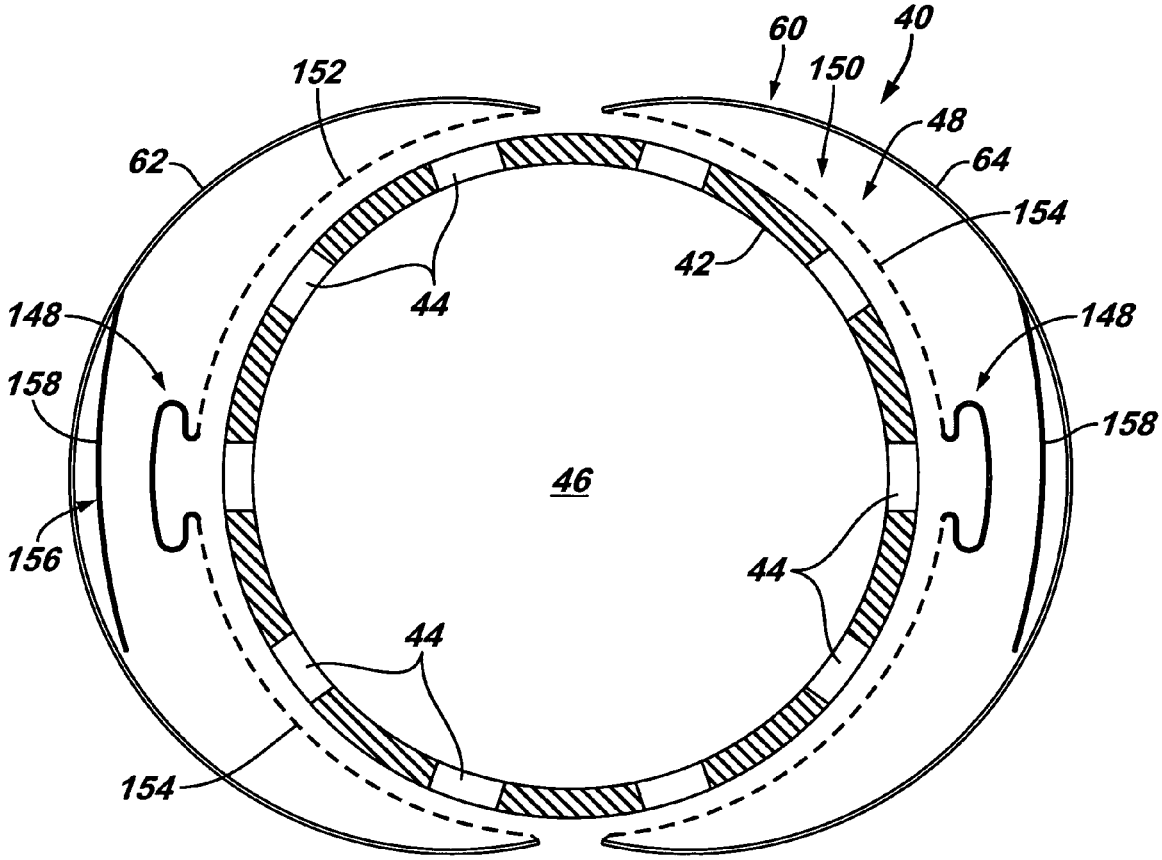
FIG. 22 illustrates another example of an expandable filtering device, according to an embodiment of the present invention.
Figure 23:
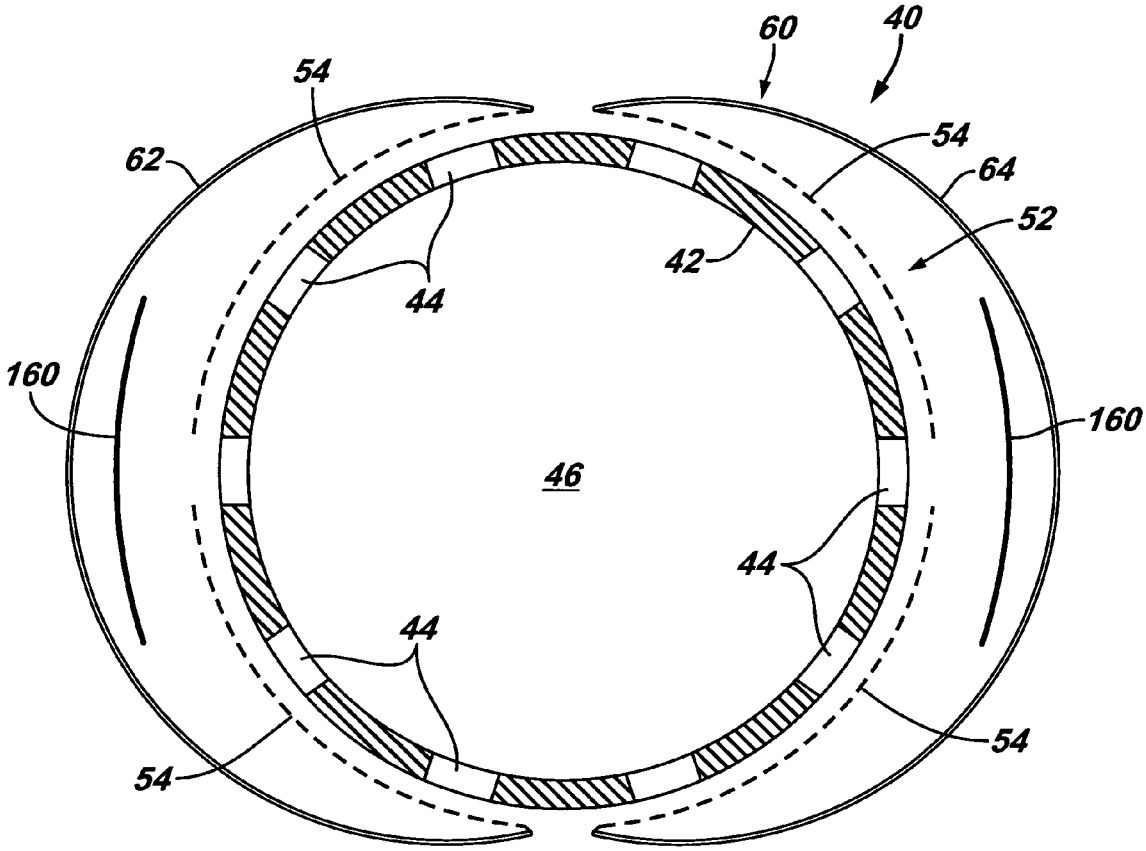
FIG. 23 illustrates another example of an expandable filtering device, according to an embodiment of the present invention.

Excess filter material used to accommodate expansion of device 40 also can be stored in a folded section or sections 148, as illustrated in FIG. 22. In this embodiment, filter 48 comprises a separable filter layer 150, similar to separable filter layer 52 illustrated in FIG. 1. However, separable filter layer 150 connects separating filter sections by a folded section 148. Folded section 148 may be a different type of filtration material sufficiently flexible to enable expansion of device 40 without creating any gaps or tears in separable filter layer 150. In this embodiment, separable filter layer 150 is divided into two filter sections 152 and 154 connected to shroud sections 62 and 64, respectively. Additionally, a supplemental filter layer 156 may be deployed intermediate shroud sections 62, 64 and separable filter layer 150. For example, supplemental filter layer 156 may be formed as a pair of expandable filter sheets 158. Alternatively, folded sections 148 may be removed, and supplemental filter sections 158 may be replaced with solid sheets 160 that block the influx of particulates into base pipe 42 through any gaps formed in the separable filter layer, as illustrated in FIG. 23.

Figure 24:
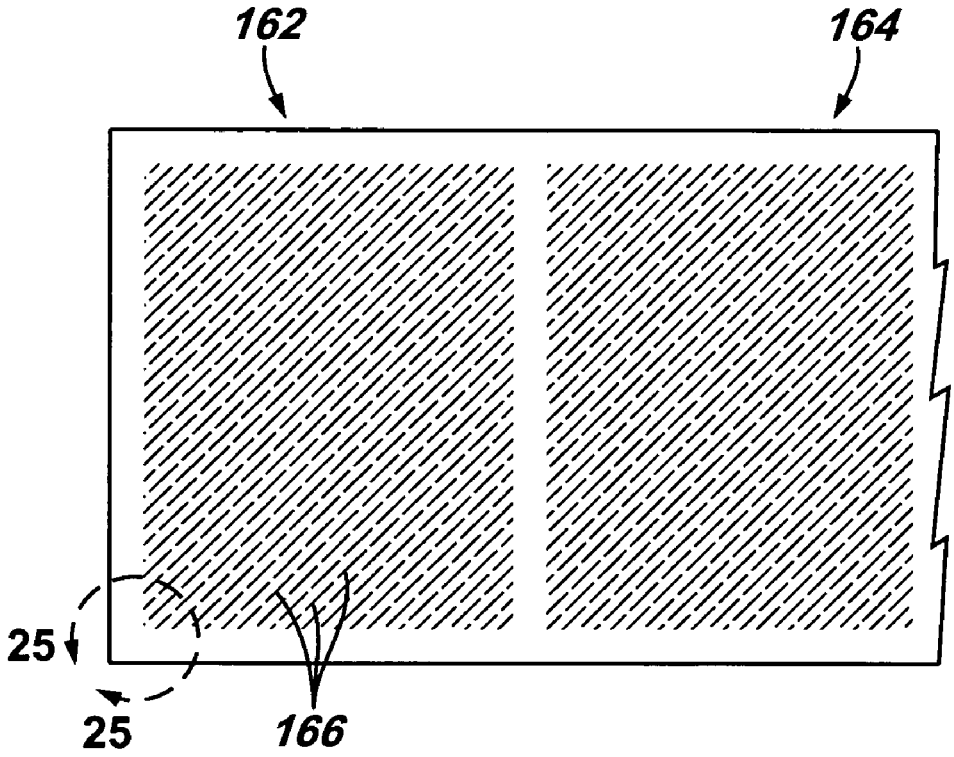
FIG. 24 illustrates an example of a sheet material used in a filter, according to an embodiment of the present invention.
Figure 25:
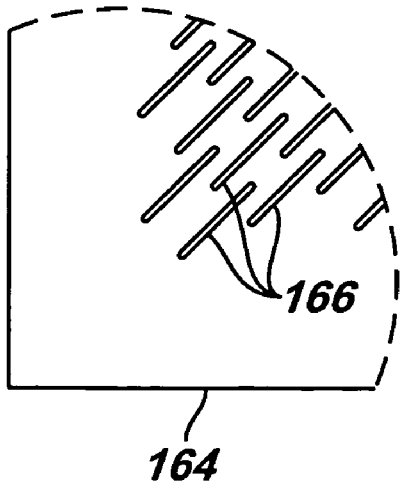
FIG. 25 illustrates an expanded section of the sheet material illustrated in FIG. 24.

In FIGS. 24 and 25, another embodiment of a filter material 162 is illustrated. In this example, filter material 162 comprises one or more sheets 164 with pores 166 formed therethrough. By way of example, the pores 166 may be formed as small slots, as illustrated best in FIG. 25. In one specific example, sheet 164 comprises a stainless steel sheet, e.g. a 316L stainless steel sheet, approximately 0.036 inches thick and having a pore opening size of approximately 0.014 inches. Such material is well-suited for a variety of sand control applications, and the material offers good erosion resistance from produced sand. However, a variety of other metals, materials, thicknesses and pore sizes may be used depending on the specific application. Additionally, the sheet 164 may be formed in two or more layers.

Figure 26:
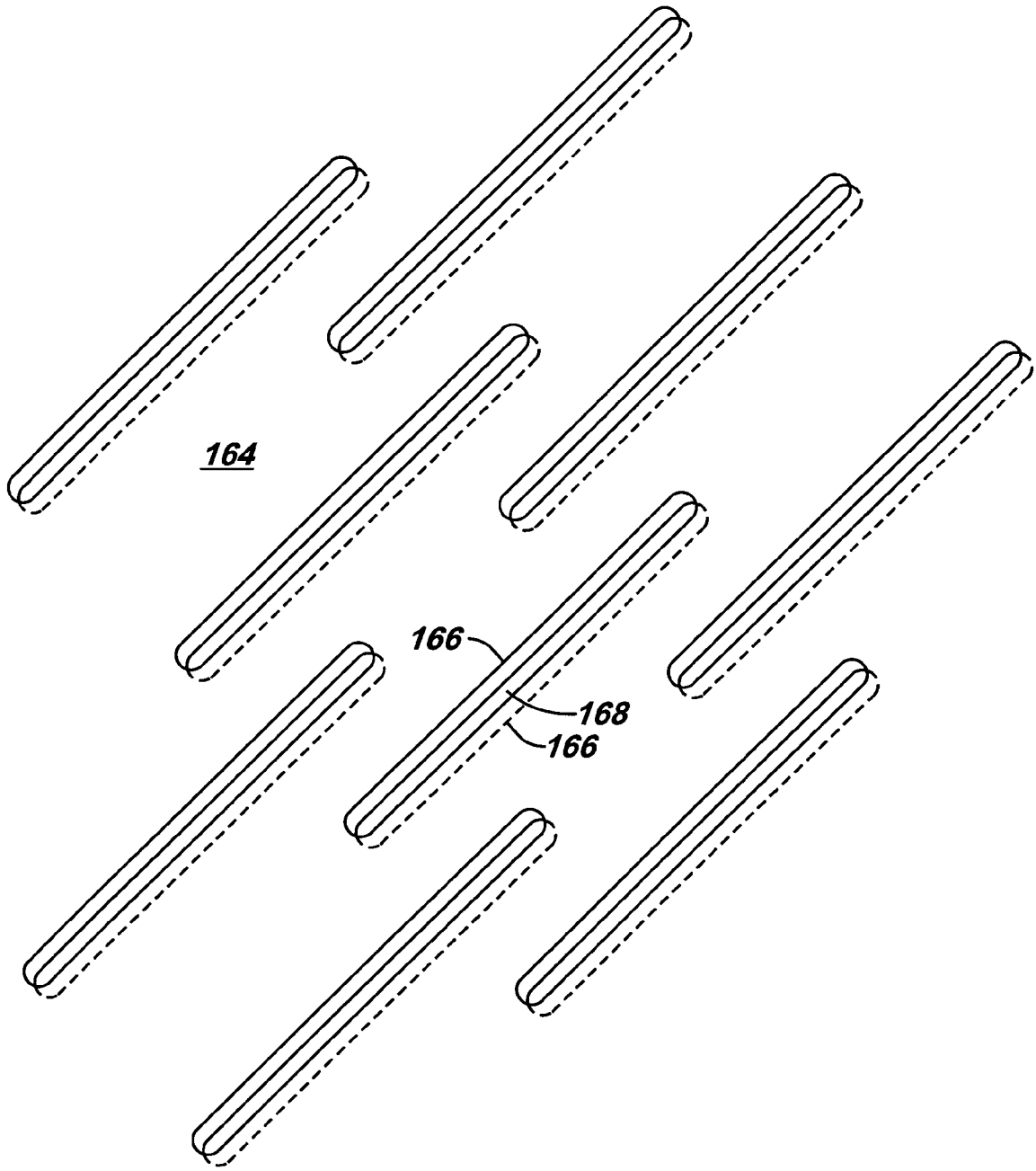
FIG. 26 illustrates the use of multiple sheets of the filter material illustrated in FIG. 25 to create filtration openings of a desired size.
Figure 27:
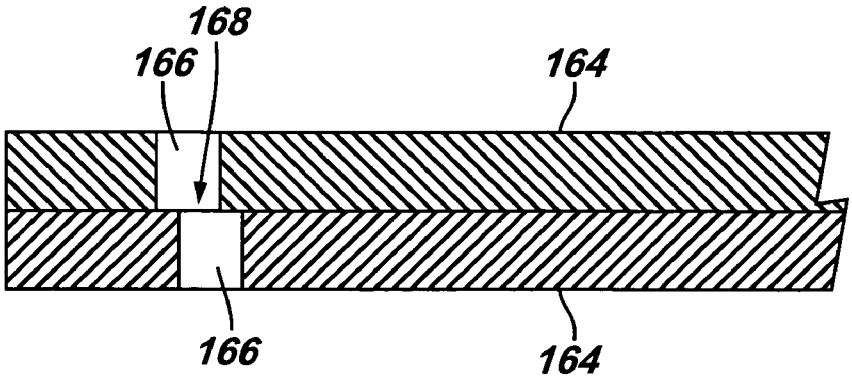
FIG. 27 illustrates the layered sheets of FIG. 26 from a cross-sectional perspective.

For example, in the specific example described in the preceding paragraph, a more cost-effective manufacture of the filter may be achieved by forming a filter layer having at least two sheets 164. For example, each sheet may be formed 0.018 inches thick with pores in the form of slots having a slot width of 0.020 inches. The slots 166 can be photoetched in the sheet, stamped or formed by other suitable methods. The two or more sheets are then pressed together with a slotted pattern slightly offset to form openings or pores 166 of desired size. If, for example, the slot width is 0.020 inches in each sheet, the resultant opening 168 may have a slot width from 0.010 to 0.022 inches with an overall material thickness of approximately 0.036 inches, as illustrated in FIGS. 26 and 27. Additional sheets 164 can be added to form a thicker layer as needed or desired. The sheets can be combined by laser welding, resistance seam welding, cold rolling or other fusing techniques. Also, the sheets can be rolled and welded helically to form tubes, formed over other filter layers to make premium sand screens, placed over perforated base pipes to replace wire wrapping, incorporated into a partial wrap screen for alternate path or instrumentation purposes, or utilized in other screen applications.

Figure 28:
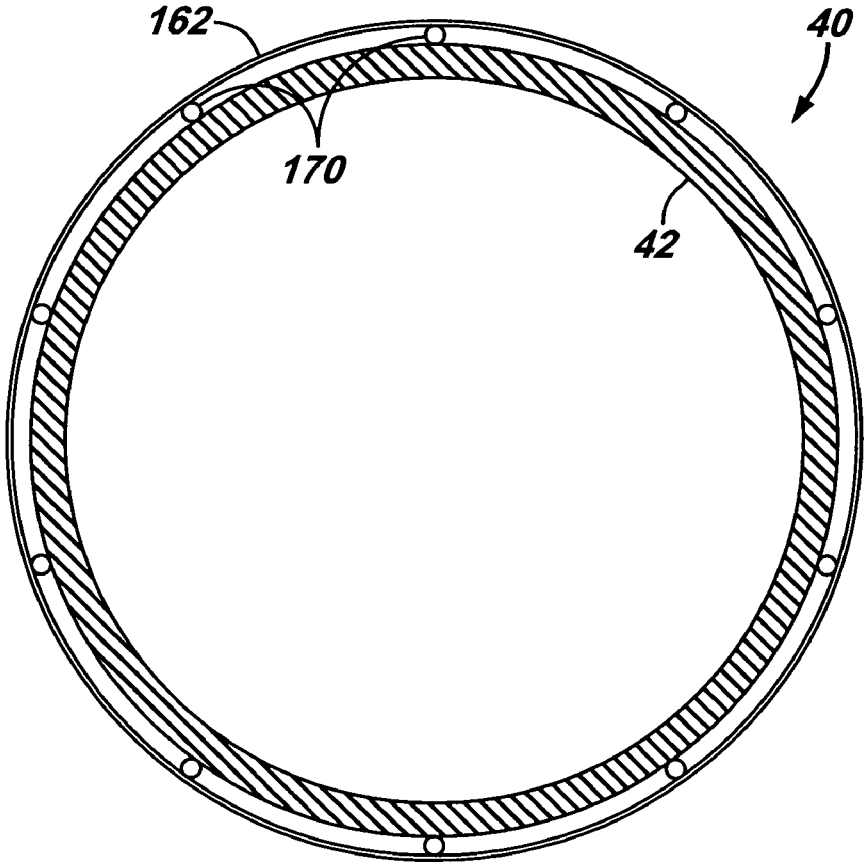
FIG. 28 illustrates another example of an expandable filtering device, according to an embodiment of the present invention.

In one implementation of filter layer 162, the combined sheets 164 are used in the formation of a rigid sand screen, as illustrated in FIG. 28. In this embodiment, rigid base pipe 42 is surrounded by a stand-off layer 170 which, in turn, is surrounded by filter layer 162. However, filter 162 with combined sheets 164 also can be used in primary filter layers of expandable screens.

Figure 29A:
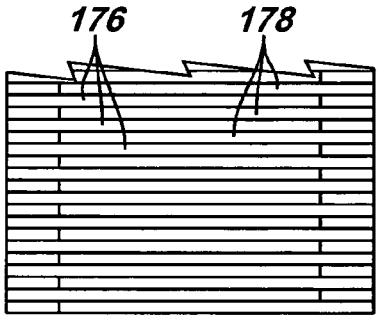
FIGS. 29A-29E illustrate another example of an expandable filtering device, according to an embodiment of the present invention.
Figure 29C:
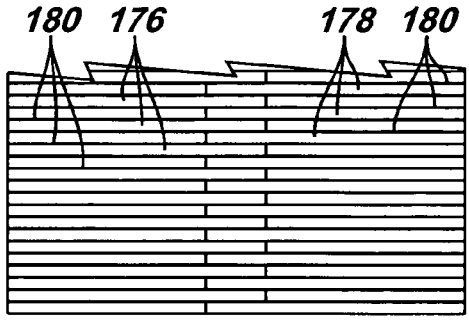
Figure 29B:
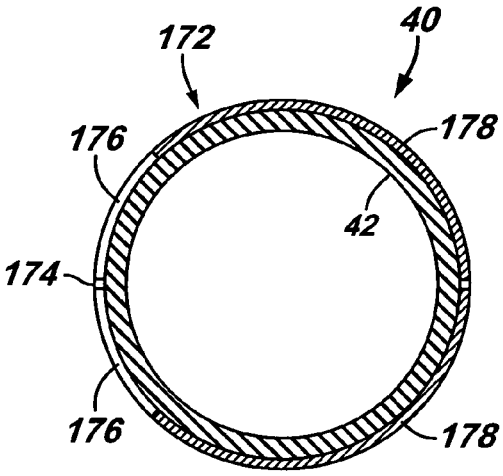
Figure 29D:
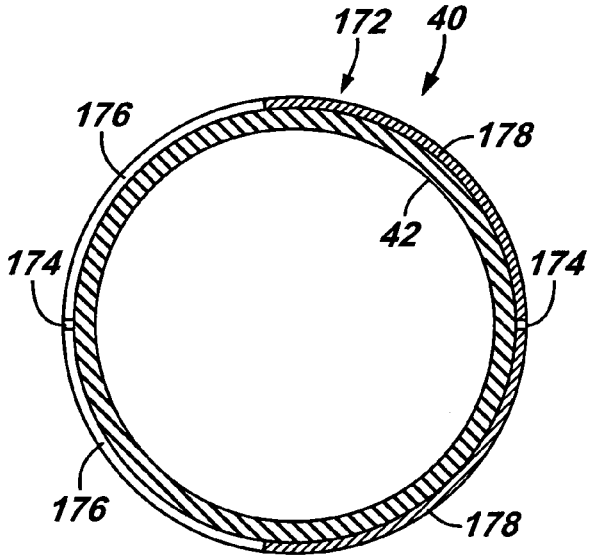

Another embodiment of expandable device 40 is illustrated in FIGS. 29A through 29E. In this embodiment, base pipe 42 is surrounded with a plurality of strands or wires 172 affixed or otherwise connected to base pipe 42 at connection points 174. The strands 172 are divided into groups or sets, such as strands 176 and strands 178 that arc around base pipe 42 and are slidably engaged with each other. One set of strands, e.g. strands 176, connects to base pipe 42 at one connection point 174, and the other set, e.g. strands 178, connects to base pipe 42 at an opposed or different connection 174, as best illustrated in FIG. 29B. The free ends of the strands 176 and 178 extend toward one another and intermesh in, for example, an alternating fashion, as illustrated in FIG. 29A. When device 40 is expanded, the strands 176 and 178 slide past one another to accommodate the expansion, as best illustrated in FIGS. 29C and 29D. The alternating strands are spaced to provide openings 180 that enable the desired filtration. Thus, after expansion, the strands 176 provide the desired filtration for one portion of the screen, and the wires 178 provide desired filtration for another portion of the screen.

Figure 29E:
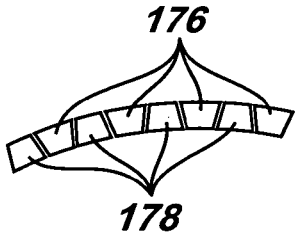

The strands 172 may have a variety of cross-sectional configurations that enable the sliding engagement. However, one exemplary configuration is illustrated in FIG. 29E. In this embodiment, each of the strands has a cross-section generally shaped as a trapezoid. In some applications, the strands 176, 178 may be held in sheet form by flexible or breakable restraint strands that extend generally laterally with respect to the strands 172. During expansion, the restraint strands (not shown) stretch or break to accommodate the expansion. Alternatively or in addition, the restraint strands may be formed of a material that disintegrates in the well environment. For example, the restraint strands may be formed of a plastic, a thin metal, a ductile metal, a fabric or other suitable materials that will disintegrate in the wellbore environment.

Figure 30:
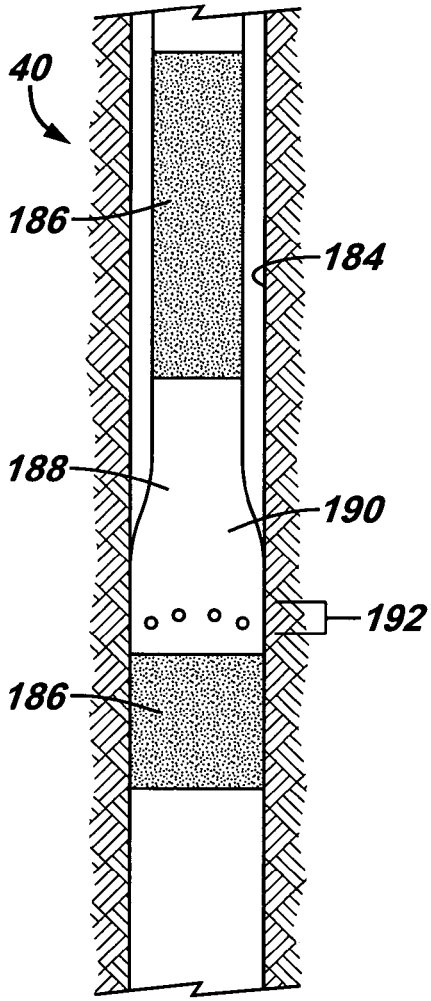
FIG. 30 illustrates another example of an expandable filtering device utilizing blank sections to isolate certain zones within a wellbore, according to an embodiment of the present invention.

Referring generally to FIG. 30, and expandable filtration system is illustrated within a wellbore 184. In this embodiment, expandable device 40 is in the form of an expandable sand screen having filtration regions 186 separated by one or more zonal isolation regions 188. The filtration regions 186 can be formed, for example, according to the techniques described above. The one or more zonal isolation regions 188, on the other hand, can be formed as blank screen sections 190. For example, each blank screen section 190 can be formed from a solid section of material, such as stainless steel.

To facilitate explanation, the expandable device 40 has been illustrated as partially expanded in FIG. 30. The partially expanded illustration is provided to show how the expandable device 40 can be expanded radially outwardly into contact with the wall of wellbore 184. The zonal isolation regions 188 isolate the inflow of fluid throughout those regions, while allowing the inflow of fluid through filtration regions 186. In many applications, the filtration regions 186 are longitudinally separated by the zonal isolation regions 188. However, the filtration regions 186 also can be circumferentially separated by the one or more zonal isolation regions 188. In some applications, better contact with the wellbore wall can be achieved by setting one or more production packers along the zonal isolation regions 188. Optionally, one or more of the blank screen sections 190 can be formed as an injection zone by replacing the blank sheets of metal with a perforated section 192. Perforated section 192 enables the injection of material, e.g.

cement, radially outwardly through the blank screen section in a zonal isolation region 188 to enhance the isolation of a particular zone.

Figure 31:
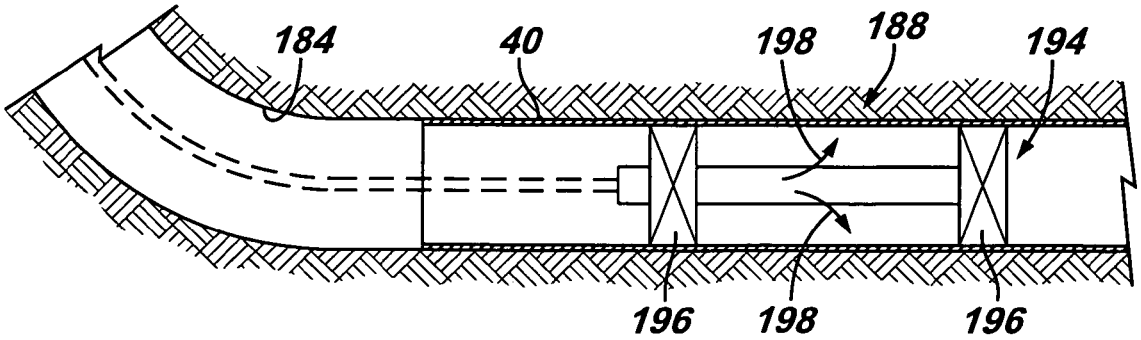
FIG. 31 illustrates another example of an expandable filtering device utilizing gel materials to isolate zones of a wellbore, according to an embodiment of the present invention.

Alternatively, blank screen sections 190 may comprise elastomer injected sheets to further enhance the zonal isolation. Additionally, blank screen sections 190 may have an elastomeric coating to, again, enhance the zonal isolation. Gel materials also may be injected radially outwardly through blank screen section 190 to block unwanted fluid flow through a particular zone of the wellbore. The injection of gels is particularly amenable to use in horizontal wellbore regions, as illustrated in FIG. 31. In the particular example illustrated, expandable device 40, e.g. and expandable sand screen, is run into wellbore 184 and expanded. The expandable device 40 may have, for example, an elastomeric coating or elastomer impregnated sheets in certain zonal isolation regions. Regardless, a completion 194 having external casing packers 196 may be placed in the expanded device 40 such that packers 196 are aligned with the zonal isolation regions of the expanded device 40. A gel 198 is injected outwardly from completion 194 between external casing packers 196 towards the wall of wellbore 184. By way of example, the injection can be accomplished with the aid of an annular gel pack or sliding sleeves that enable the movement of gel into the space between the packers. The gel then hardens to improve the seal within a particular zonal isolation region 188.

Although only a few embodiments of the present invention have been described in detail above, modifications are possible without materially departing from the teachings of this invention. Accordingly, such modifications are intended to be included within the scope of this invention as defined in the claims.

What is claimed is:

1. An expandable sand screen for use in a wellbore, comprising:

an expandable base pipe;

a base filter layer disposed along the expandable base pipe; and a separable filter layer disposed along the base pipe, the base filter layer having a solid region disposed at a separation area of the separable filter layer wherein the base filter layer and the separable filter layer are not directly connected to the base pipe.

2. The expandable sand screen as recited in claim 1, further comprising a shroud surrounding the base filter layer.

3. The expandable sand screen as recited in claim 2, wherein the base filter layer and the separable filter layer are secured to the shroud.

4. The expandable sand screen as recited in claim 2, wherein the shroud comprises a plurality of shroud sections affixed to the base pipe.

5. The expandable sand screen as recited in claim 2, further comprising at least one backing strip extending longitudinally along the expandable base pipe, the backing strip serving to connect the shroud to the expandable base pipe.

6. The expandable sand screen as recited in claim 5, wherein the backing strip comprises a channel for receiving a control line.

7. The expandable sand screen as recited in claim 1, wherein the base filter layer is located along an exterior of the base pipe and between the separable filter layer and the base pipe.

8. The expandable sand screen as recited in claim 1, wherein the separable filter layer is a woven filter.

9. The expandable sand screen as recited in claim 1, wherein the separable filter layer comprises a plurality of filter pairs, each filter pair being separated by a gap upon expansion of the base pipe.

10. An expandable sand screen for use in a wellbore, comprising:

an expandable base pipe;

a base filter layer disposed along the expandable base pipe;

a separable filter layer disposed along the base pipe, the base filter layer having a solid region disposed at a separation area of the separable filter layer; and a shroud surrounding the base filter layer wherein the shroud comprises a plurality of shroud sections affixed to the base pipe.

11. An expandable sand screen for use in a wellbore, comprising:

an expandable base pipe;

a base filter layer disposed along the expandable base pipe;

a separable filter layer disposed along the base pipe, the base filter layer having a solid region disposed at a separation area of the separable filter layer;

a shroud surrounding the base filter layer; and at least one backing strip extending longitudinally along the expandable base pipe, the backing strip serving to connect the shroud to the expandable base pipe.

12. The expandable sand screen as recited in claim 11, wherein the backing strip comprises a channel for receiving a control line.

* * * * *